United States Patent [19]

Yasuda et al.

[11] Patent Number: 4,615,526

[45] Date of Patent: Oct. 7, 1986

[54] COMPUTING GOLF TRAINER WITH MAGNETIC SENSOR

[75] Inventors: Yoshinori Yasuda; Akio Takase; Koji Ogawa; Takao Tsutsumi; Hiroaki Taguchi, all of Gunma, Japan

[73] Assignee: Mitsubishi Denki Kabushiki Kaisha, Tokyo, Japan

[21] Appl. No.: 792,625

[22] Filed: Oct. 25, 1985

Related U.S. Application Data

[63] Continuation of Ser. No. 427,379, Sep. 29, 1982, abandoned.

[30] Foreign Application Priority Data

| | | | |
|---|---|---|---|
| Sep. 30, 1981 | [JP] | Japan | 56-155963 |
| Feb. 19, 1982 | [JP] | Japan | 57-25286 |
| Feb. 22, 1982 | [JP] | Japan | 57-23719 |
| Feb. 22, 1982 | [JP] | Japan | 57-23723 |
| Mar. 1, 1982 | [JP] | Japan | 57-31898 |
| Mar. 1, 1982 | [JP] | Japan | 57-31899 |

[51] Int. Cl.[4] ..... A63B 69/36

[52] U.S. Cl. ..... 273/183 A; 273/186 A; 273/186 C; 273/186 D; 273/1 M; 434/252

[58] Field of Search ..... 273/1 M, 11 C, 48, 49, 273/54 A, 181 E, 181 F, 181 G, 181 H, 181 J, 186 R, 186 A, 186 B, 186 C, 186 D; 307/134, 252 UA; 324/166, 179

[56] References Cited

U.S. PATENT DOCUMENTS

| | | | |
|---|---|---|---|
| 2,524,546 | 10/1950 | Sinclaire | 273/118 A |
| 4,015,845 | 4/1977 | Sines | 273/11 C |
| 4,088,324 | 5/1978 | Farmer | 273/186 A |
| 4,254,956 | 3/1981 | Rusnak | 273/181 H |
| 4,317,077 | 2/1982 | Zwartz | 324/166 |
| 4,396,932 | 8/1983 | Alonas et al. | 307/252 UA |
| 4,412,547 | 11/1983 | Callahan et al. | 128/731 |

FOREIGN PATENT DOCUMENTS

| | | | |
|---|---|---|---|
| 3001924 | 7/1981 | Fed. Rep. of Germany . | |
| 2011086 | 7/1979 | United Kingdom . | |
| 2066676 | 7/1981 | United Kingdom | 273/186 A |

*Primary Examiner*—William H. Grieb
*Assistant Examiner*—MaryAnn Stoll Lestova
*Attorney, Agent, or Firm*—Sughrue, Mion, Zinn Macpeak & Seas

[57] ABSTRACT

A golf trainer includes one or more magnetic sensors disposed at predetermined locations relative to an ideal swing path of a golf club head. The outputs of the magnetic sensors are amplified and processed to calculate such parameters as the club head velocity, swing orbit, face angle, and ball carry, as examples. A suitable display device is used to provide the trainer user with instantaneous feedback relative to the success of a given practice swing.

5 Claims, 46 Drawing Figures

COMPUTING GOLF TRAINER WITH MAGNETIC SENSOR

This is a continuation of application Ser. No. 427,379, filed Sept. 29, 1982, now abandoned.

BACKGROUND OF THE INVENTION

The present invention relates to an electronic golf trainer, and more particularly, to a means for processing a signal indicative of the moving state of a club head.

Generally speaking, habitual, rational and continuous training is essential to progress in golf. Usage of an exclusive trainer is a good way to practice golf rationally. However, the user of such a trainer was not able to measure either the orbit of the swinging head or where the ball was hit. All he could do was simply rely on his own feeling upon hitting. In addition, to increase the carry of the ball, having the precise factors determining the carry, that is, the velocity of the club head and the direction in which the ball is hit, is important to golf practice. Especially in order to have a longer carry with greater accuracy, a precise blow to the ball by the sweet spot of the club head as well as a correct swing is important. However, in reality, it is by no means possible for the human eye to follow the orbit of a club head or note the angle of the face thereof when it moves at a velocity of 30 m/sec or faster at the moment when it hits the ball. It is obvious, therefore, that improvements can be expected if the hit positions and the face angle can be objectively judged in practice.

SUMMARY OF THE INVENTION

In view of the foregoing, it is an object of the present invention to provide a golf trainer which includes a sensor for detecting the movement of a swinging club head to produce a signal, a level processing means for performing level processing based on this signal, and a zero-crossing discrimination means for detecting the zero-crossing point of a certain voltage waveform and for processing it based on the detected signal from the sensor, thereby permitting various information relative to the swing to be displayed as precise and objective data.

It is also an object of the present invention to provide a golf trainer which can eliminate the induced noise produced by a magnetic sensor which is superposed on the detected signal to thereby precisely derive information relative to the swing only.

It is a further object of the present invention to provide a golf trainer which includes magnetic sensors for detecting the movement of a swinging club head, a circuit for receiving output signals from the magnetic sensors to produce an output indicative of the impact position of the ball with the club face, and display means for displaying the output from the processing circuit, to enable a golfer to determine the swing orbit of the club head near its impact point.

It is another object of the present invention to provide a golf trainer which includes at least three magnetic sensors for detecting a swinging club head to produce output signals and which can precisely display the face angle of the club head based on the outputs of the magnetic sensors.

It is a still further object of the present invention to provide a golf trainer which includes at least two magnetic sensors for detecting the swinging club which can precisely display the speed of the club head based on the outputs of the magnetic sensors.

It is also an object of the present invention to provide a golf trainer which includes sensors disposed on opposite sides of the center line of the swing orbit for detecting the club head, a means for processing signals produced by the sensors due to the passage of the club head, and means for the precise and rapid display of objective club swing information.

DETAILED DESCRIPTION OF THE PREFERRED EMBODIMENTS

Figure 1A:
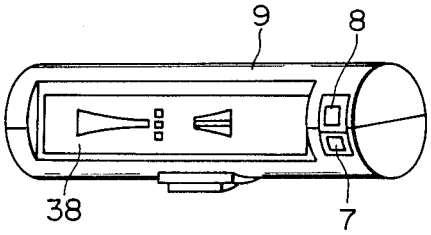
FIGS. 1(*a*) and 1(*b*) are perspective views of one embodiment of a golf trainer of the invention.
Figure 1B:
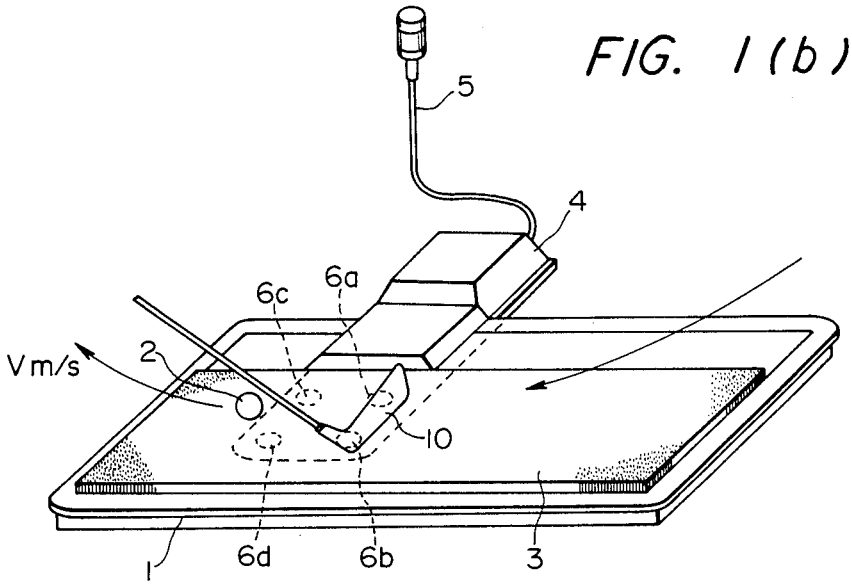
Figure 2A:
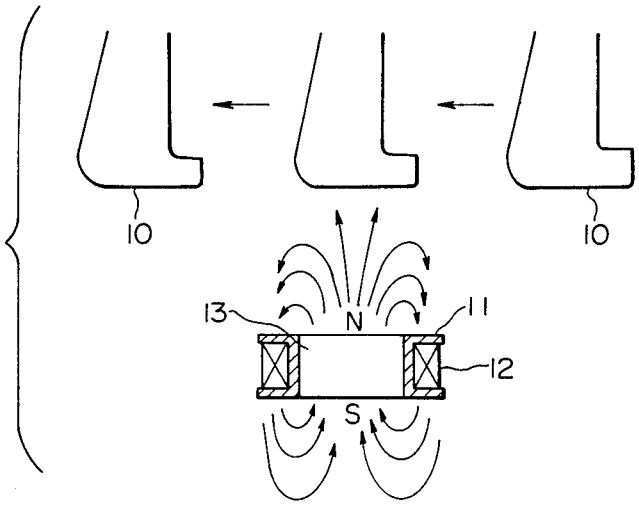
FIGS. 2(*a*) and 2(*b*) are views illustrating the principles of operation of a simplified sensor of FIGS. 1(*a*) and 1(*b*)
Figure 2B:
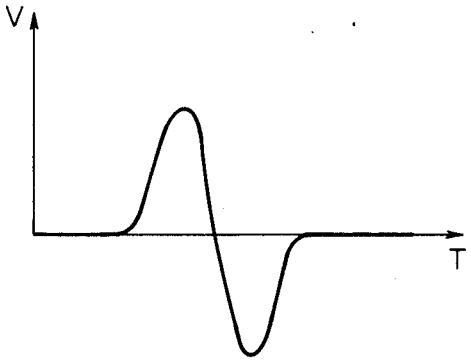

Referring to the drawings, there is shown in FIG. 1 a golf mat 1 having a lawn-like portion 3 formed on its upper portion, and a golf ball 2 (which is not necessarily required) placed on the lawn-like portion. A sensor case 4 removably installed in this mat has a pair of fork-like protrusions which hold signal generating magnetic sensors 6*a*, 6*b* and 6*c*, 6*d*, respectively, therein. The sensor case also contains an analog processing circuit 14 which will be described later. Each of these sensors, as seen in FIG. 2, consists of a coil 12 wound on a bobbin 11 and a permanent magnet 13 inserted and bonded in the central bore of the bobbin 11. A display unit 9 (shown in FIG. 1) contains a display device 38, a club selecting key 8 which can be actuated from the outside, and a carry/head speed change-over key 7. The display device 38 comprises a digital processing circuit 15 (to be described later) for receiving signals from the aforementioned analog processing circuit 14 through a connecting cord 5, an operational circuit 16, and a liquid crystal display device that displays the results of calculations performed by the operational circuit 16 and which consumes a relatively small quantity of electric power. Indicated by numeral 10 is an iron club head, for example.

The principle of operation of the sensors 6*a*, 6*b*, 6*c* and 6*d* according to the present invention will be described, but for convenience, the description will relate only to the club head 10 and sensor 6*b*. When the club head 10 passes over the sensor 6*b* at a certain velocity as shown in FIG. 2(*a*), the flow of magnetic force lines issuing from the permanent magnet 13 will vary. The result is that the quantity of magnetic force lines passing through the coil 12 then varies, resulting in the generation of an induced electromotive force in the coil 12, thus producing a voltage output waveform as shown in FIG. 2(*b*). The voltage value of this waveform increases in proportion to the velocity at which the club head 10 passes over the sensor 6*b*, and similarly the frequency of the waveform increases in proportion to the velocity.

Further, the voltage value increases as the height at which the club head 10 passes over the sensor 6*b* is lowered. Sensor outputs $e_a$, $e_b$, $e_c$ and $e_d$ obtained according to the principles described hereinbefore are processed to derive various information relative to the club swing.

Figure 3:
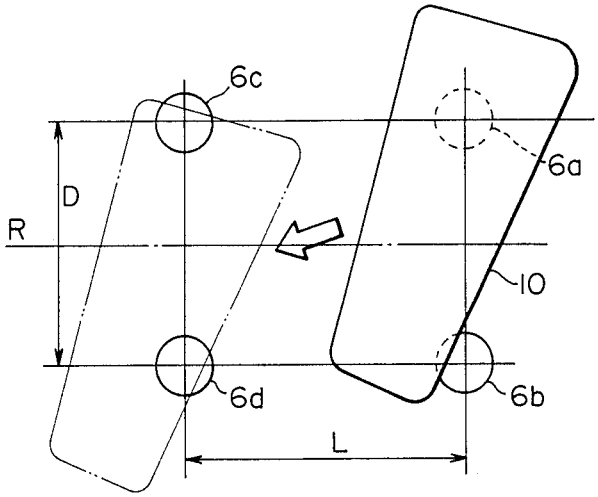
FIG. 3 is a view illustrating the arrangement of the simplified sensors.
Figure 4:
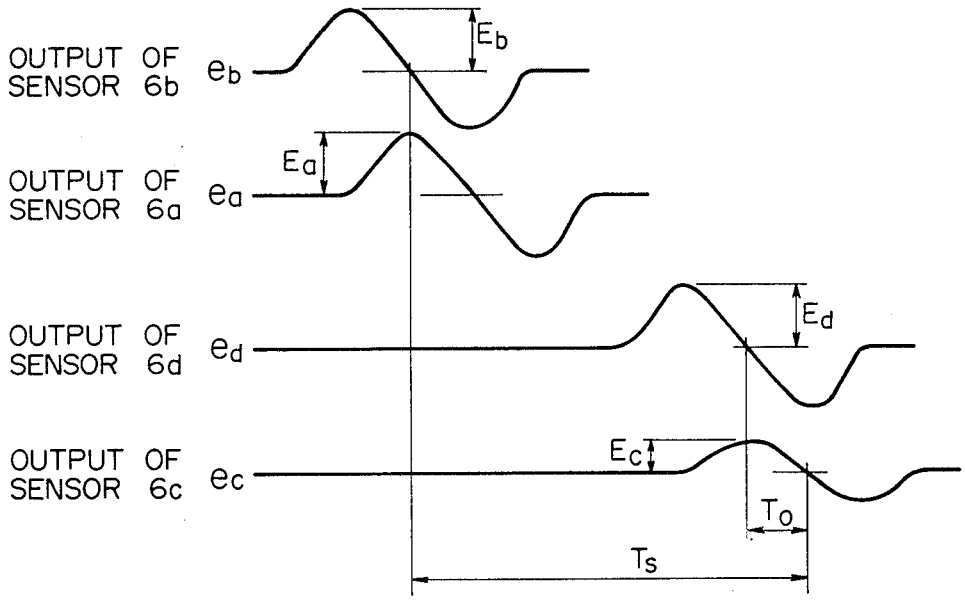
FIG. 4 shows waveforms indicative of detected signals from the sensors of FIG. 1.
Figure 5:
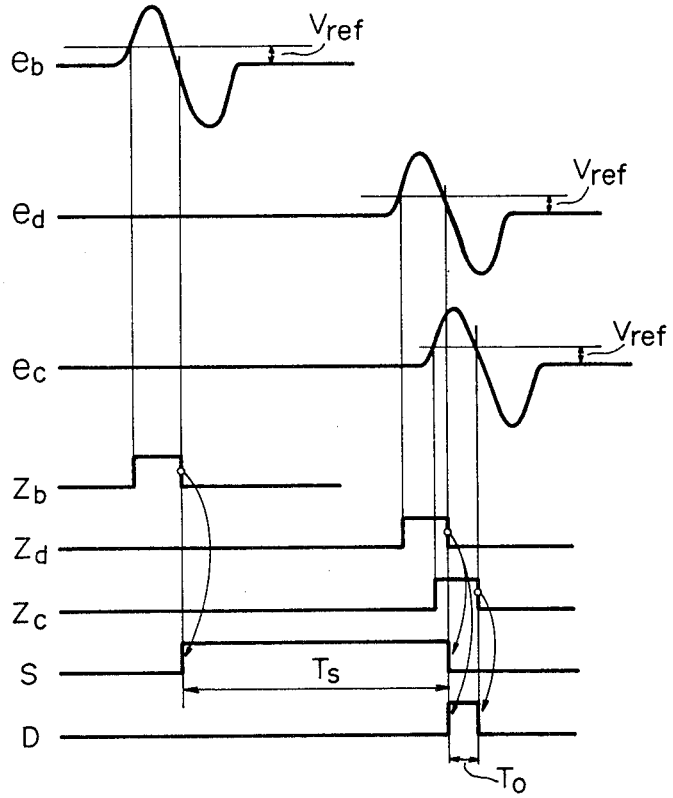
FIG. 5 is a timing chart for detecting a zero-crossing waveform.

An example of the detection of such information will now be described. Referring first to FIGS. 3, 4 and 5, the velocity of a club head and the face angle thereof are described. If the club head 10 moves in a direction indicated by an arrow as it is swung as shown in FIG. 3, then the outputs from the four sensors will be the signals $e_a$, $e_b$, $e_c$ and $e_d$ shown in FIG. 4, which in turn are converted to digital signals $Z_b$, $Z_d$ and $Z_c$ shown in FIG. 5 to obtain the periods of time $T_s$ and $T_o$ it takes for the club head 10 to pass the interval between the sensors 6*b* and 6*d* and that between the sensors 6*d* and 6*c*, respectively.

Figure 7:
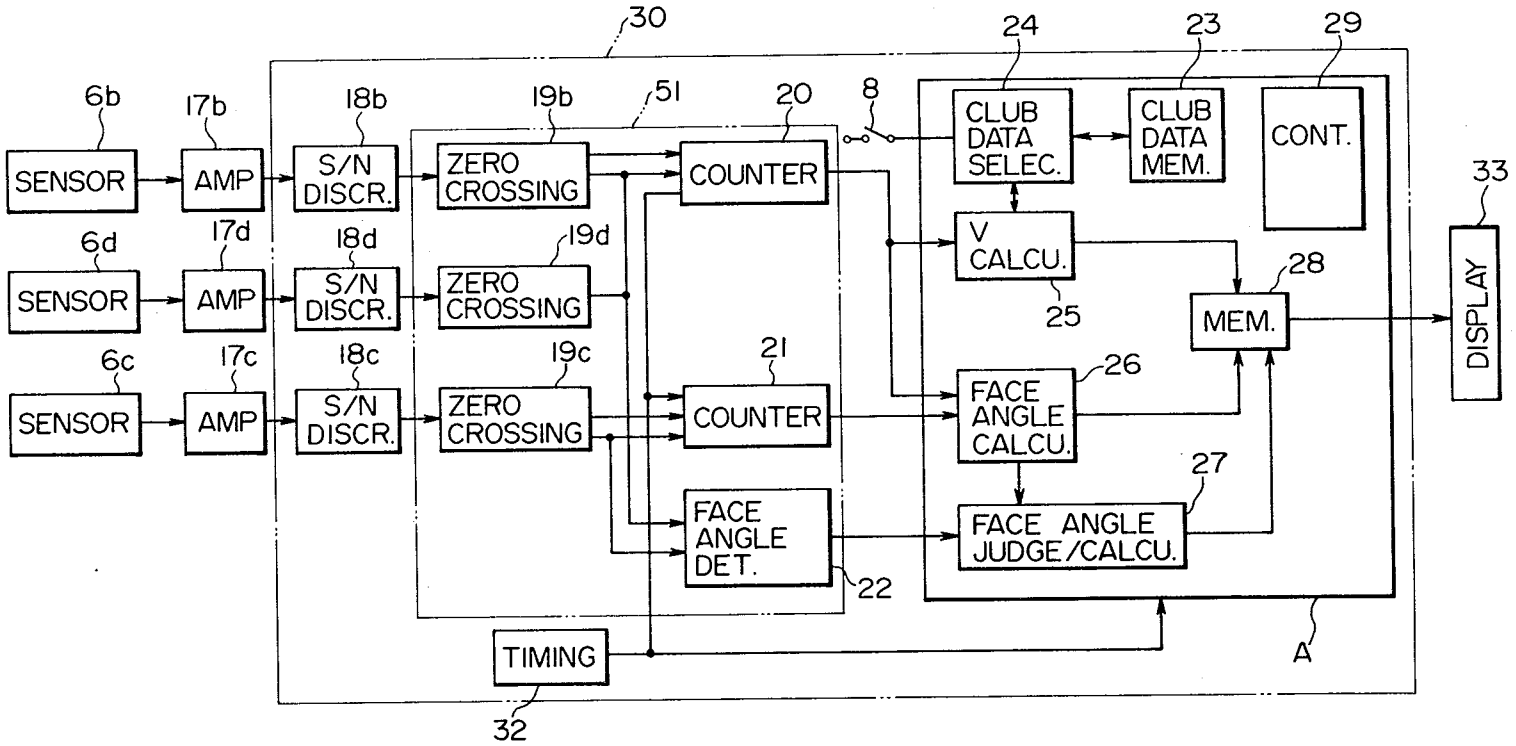
FIG. 7 is a circuit diagram of a device for determining head velocity and face angle.

A control circuit 30 of the present invention utilizing the principle of detection described hereinabove will now be described in detail. Referring to FIG. 7, indicated by numerals 17*b*, 17*d* and 17*c* are amplifiers which amplify the respective minute detected signals from the sensors 6*b*, 6*d* and 6*c* by a given factor. SN discriminators 18*b*, 18*d* and 18*c* discriminate only those necessary signals indicative of the swinging state from among the output signals including noise and the signals of interest. Zero-crossing detectors 19*b*, 19*d* and 19*c* further amplify the signals $e_b$, $e_d$ and $e_c$, respectively, and select points of induced electromotive voltage which cross the reference zero voltage, at which points maximum lines of magnetic force are developed, in order to obtain signals from a fixed position on the sole, that is, the flattened bottom of the club head 10, which may take various shapes. Then, the zero-crossing detectors produce signals $Z_b$, $Z_d$ and $Z_c$, each in the form of a pulse falling at the zero-crossing point. Indicated at numeral 20 is a counter circuit which measures the time $T_s$ between the pulse signals $Z_b$ and $Z_d$, while a counter circuit 21 measures the time $T_O$ between the pulse signals $Z_d$ and $Z_c$. A club face direction judgment circuit 22 judges the direction at which the club face forms an angle with its direction of travel, from the pulse signals $Z_d$ and $Z_c$. A club data memory 23 stores predetermined data individually set for various clubs. A club data selecting portion 24 is operated by the memory in accordance with the flow chart shown in FIG. 8, and selects club data in response to the club desired at that time. A velocity calculator 25 calculates the velocity of that club head based on the time $T_s$ from the first counter circuit 20. A face angle calculator 26 calculates the face angle at the moment of impact based on the time $T_O$ from a counter circuit 21 and the time $T_s$ from the counter circuit 20. A face angle judging and calculating unit 27 judges whether the data from the face angle calculator 26 represents an open club face state or a closed state based on the signal from the club face angle judging circuit 22. A temporary storage unit 28 temporarily stores data calculated by the velocity calculator 25, face angle calculator 26 and face angle judging and calculating unit 27.

Figure 8:
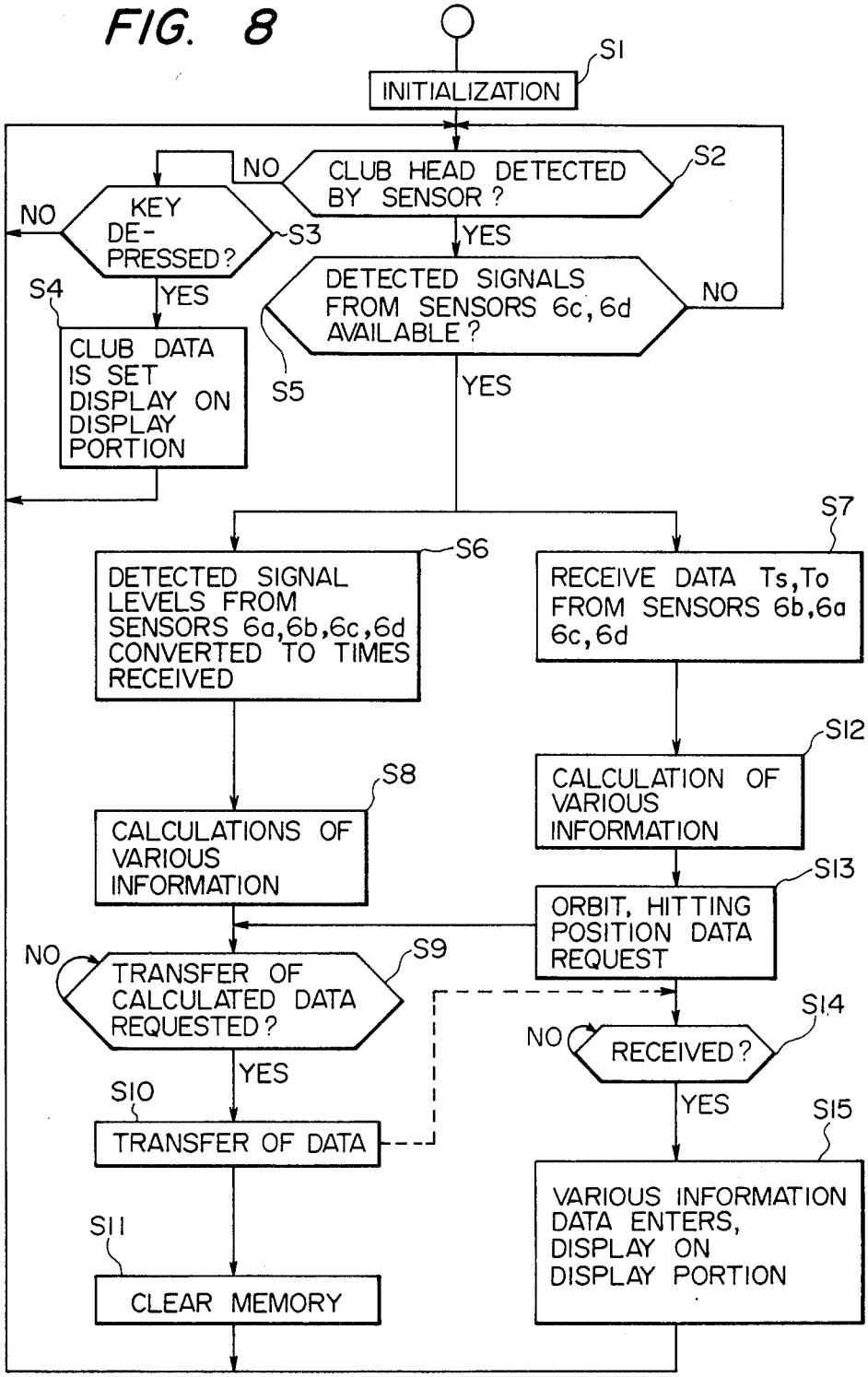
FIG. 8 is a flow chart showing how various information is calculated.

A control unit 29 controls operations on the flow chart shown in FIG. 8 in accordance with a predetermined format and also stores a program for storing and displaying data concerning a ball carry calculation and a distance-from-target calculation and various data on hitting positions, club head orbits and so forth. The control unit 29 further stores a program for controlling data processing and calculation in one embodiment of the present invention. The contents of the storage unit 28 are displayed on a display portion 33. The aforementioned velocity calculator 25, face angle calculator 26, face angle judging and calculating unit 27, storage unit 28, control unit 29, club data memory 23 and club data selecting portion 24 may be included in a central processing unit 31 which consists of a microcomputer A, for example. A timing control unit 32 generates timing signals for controlling the microcomputer and counter circuits 20 and 21. The aforementioned zero-crossing detectors **19*b*, 19*c* and 19*d*, counter circuits 20 and 21 and judging circuit 22 make up a zero-crossing discrimination circuit 51** acting as a zero-crossing discriminating means.

Figure 9:
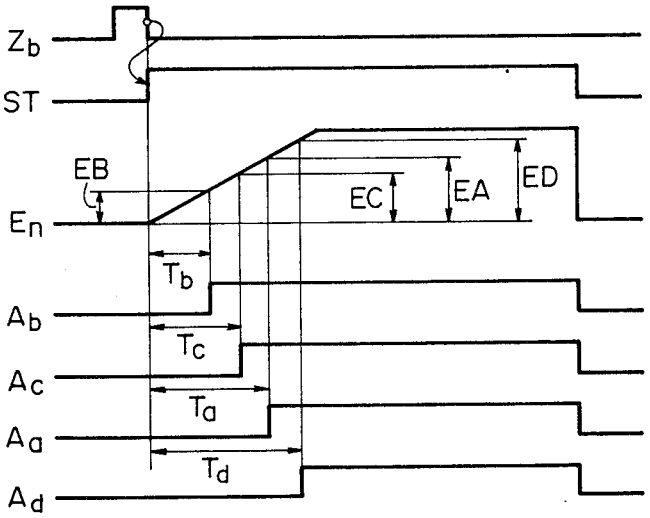
FIG. 9 is a timing chart for converting detected signal levels from the sensors into time values.

Referring next to FIGS. 3, 4 and 9, the detections of the orbit or blow of the club head and of the impact position are described. When the club head 10 moves in the direction indicated by the arrow as it is swung as shown in FIG. 3, the sensors produce signals $e_a$, $e_b$, $e_c$ and $e_d$ as shown in FIG. 4, and these signals have maximum output values $E_a$, $E_b$, $E_c$ and $E_d$, respectively, as shown in FIG. 4. Then, these signals are converted to digital signals $A_b$, $A_a$, $A_c$ and $A_d$ as shown in FIG. 9, and the output voltage difference between the sensors **6*b* and 6*a* and between the sensors 6*d* and 6*c*** are detected.

Figure 10:
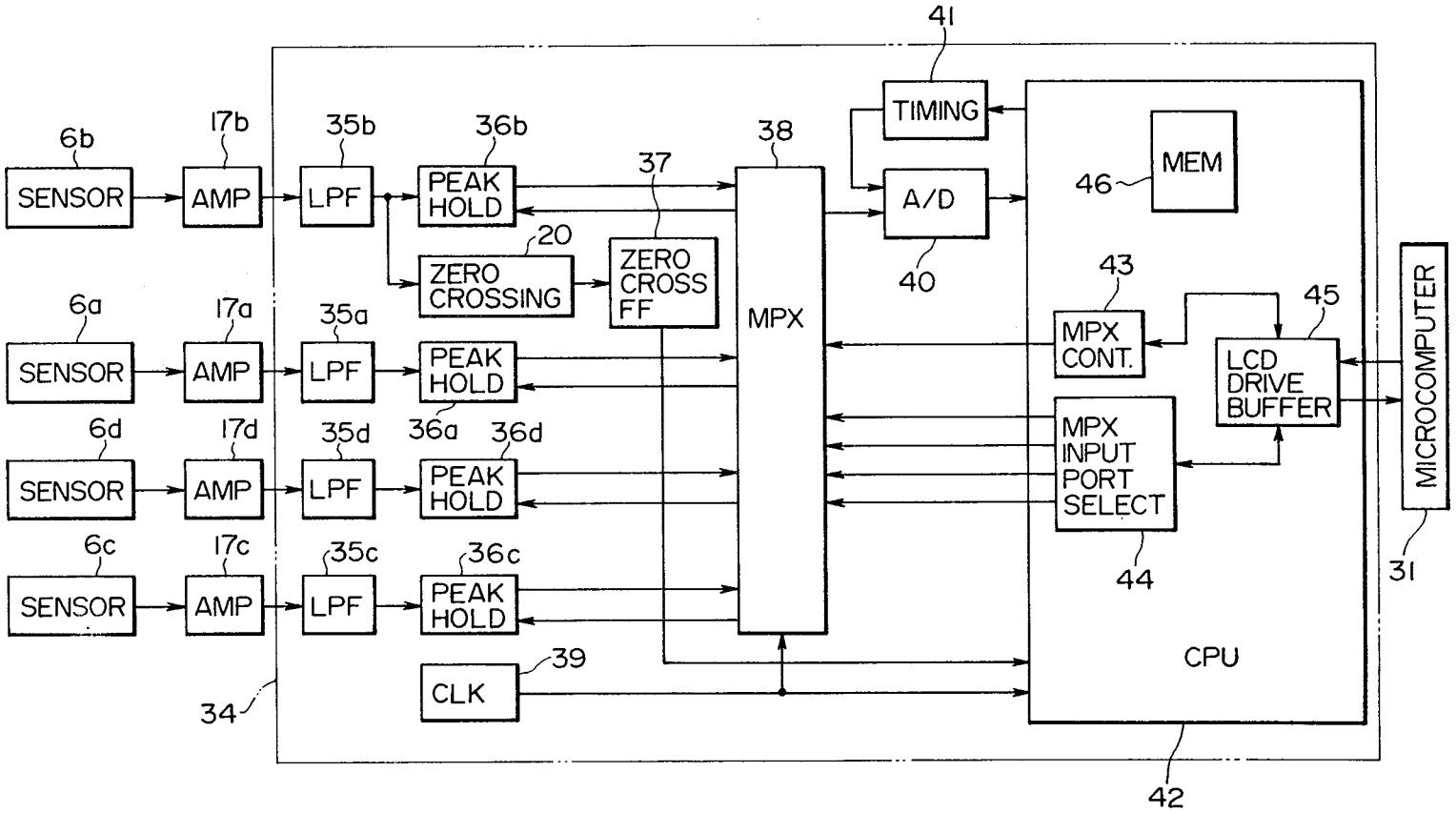
FIG. 10 is a circuit diagram of a device calculating the swing orbit and hitting position.

A control circuit 34 which operates using the detection principle described hereinabove and acts as a processing means will be described in detail. Referring to FIG. 10, amplifiers **17*b*, 17*a*, 17*c* and 17*d* amplify signals from the sensors 6*b*, 6*a*, 6*d* and 6*c*, respectively, by a given factor to produce outputs EB, EA, EC and ED, which in turn are applied to respective low pass filters (abbreviated as LPF hereinafter) 35*b*, 35*a*, 35*d* and 35*c* to filter out the high frequency components of the noise induced in the sensors which includes low and high frequency components. The cut-off frequency of the LPFs is set to a frequency equivalent to the highest possible velocity, for example 60 m/sec, of a swinging club head, which value is statistically derived. Peak holding circuits 36*b*, 36*a*, 36*c* and 36*d* hold the outputs signals EB, EA, EC and ED from the LPFs at a constant value, and a multiplexer 38 (abbreviated MPX hereinafter) converts outputs from the peak holding circuits into serial data in response to instructions from a microcomputer 42 (described later) containing a multiplexer control unit 43 to produce output signals EB, EA, EC and ED, which are converted in turn to digital signals $T_b$, $T_a$, $T_c$ and $T_d$ in succession by an analog-to-digital (A/D) converter 40. A reference timing circuit 41** sets the reference timing for the analog-to-digital conversions.

A microcomputer 42 acting as a central processing unit receives an output from the A/D converter 40 and produces signals which are applied to the peak holding circuits **36*b*, 36*a*, 36*c* and 36*d* via the MPX 38 to reset the peak holding circuits. Processing by the microcomputer 42 is initiated by a start signal from a zero-crossing judging flip-flop circuit (abbreviated as ZJFF hereinafter) 37, which receives an input from a zero-crossing detecting circuit 20 coupled to LPF 35*b*. The microcomputer calculates the relative positions of the club head 10 and the sensors 6*b*, 6*a* and of the club head 10 and the sensors 6*d*, 6*c* based on clock pulses from a clock pulse oscillator circuit 39. The microcomputers 42 and 31 transfer the result of their calculations to each other. In the microcomputer 42, reference numeral 44 represents an MPX input port selecting unit for designating the output of the peak holding circuit 36*a*–36*d* which is to be subjected to A/D conversion. The operation program for the microcomputer is contained in a memory unit 46. Output data to be displayed is delivered to a display unit 31 by way of an LCD drive buffer 45** for controlling the display operation.

The structure described hereinabove permits calculation of the following information relative to a club swing: (1) the velocity of the club head, (2) the carry of the ball, (3) the face angle at the moment of impact, (4) the direction in which a ball is hit, (5) the orbit of the club head, (6) the impact position, (7) the distance from a target to the spot at which the ball landed, (8) a judgment as to whether the ball fell within a "fairway."

With respect to the club head velocity V of item (1) above, this may be approximately calculated by the following equation:

$$V=L/T_s$$

Figure 11A:
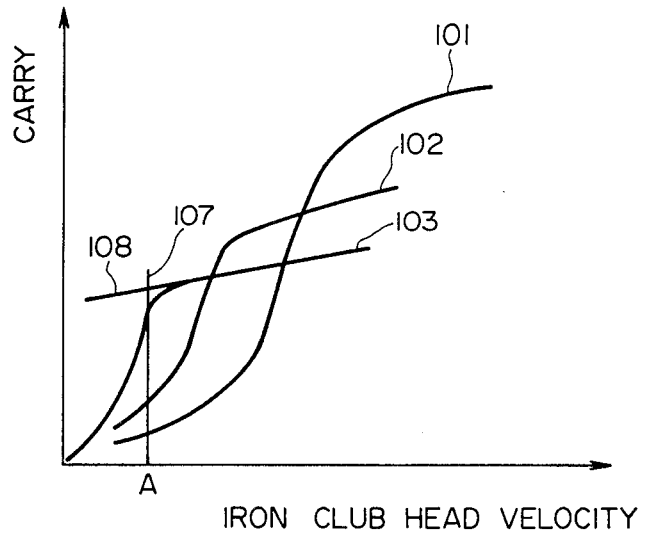
FIGS. 11(*a*) and 11(*b*) show curves illustrating the relations between head velocities and ball carry.
Figure 11B:
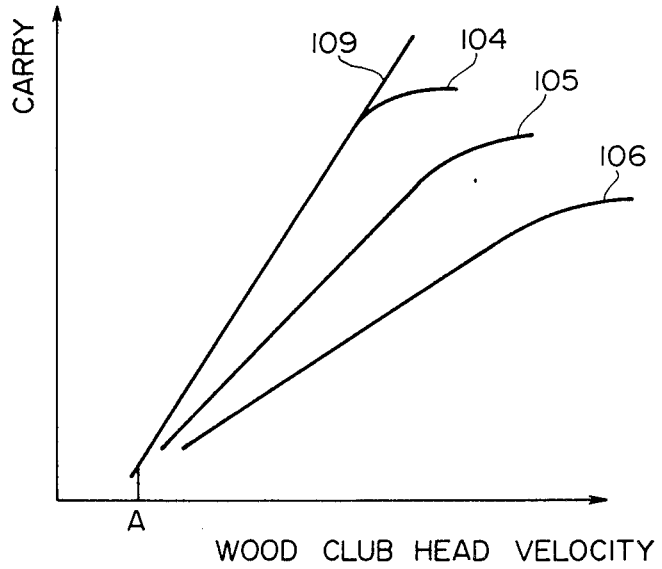
Figure 12:
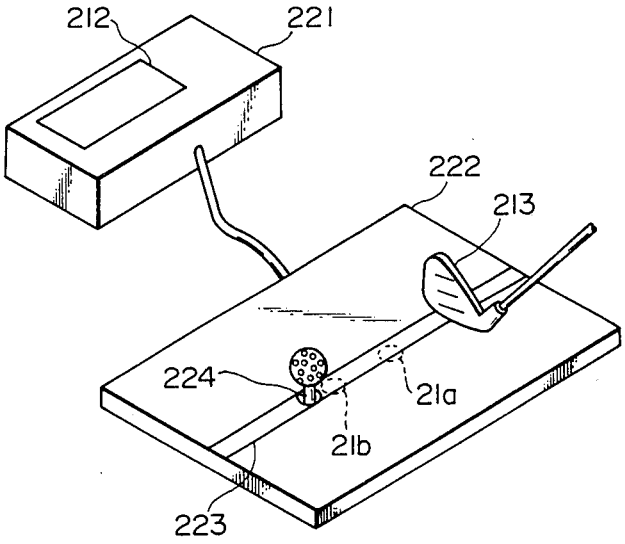
FIG. 12 is a perspective view of a second embodiment of a golf trainer according to the present invention.
Figure 13:
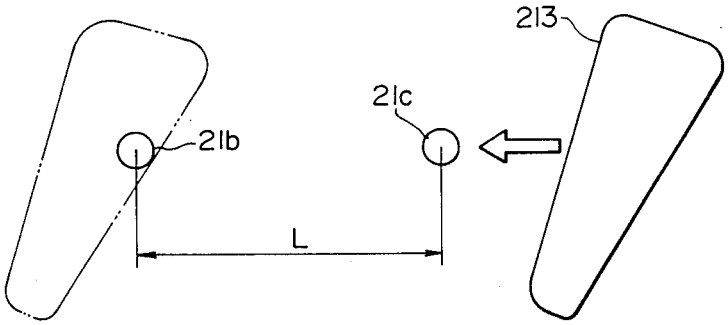
FIG. 13 is a diagram illustrating the interrelations between the magnetic sensors and a simplified club head.
Figure 14:
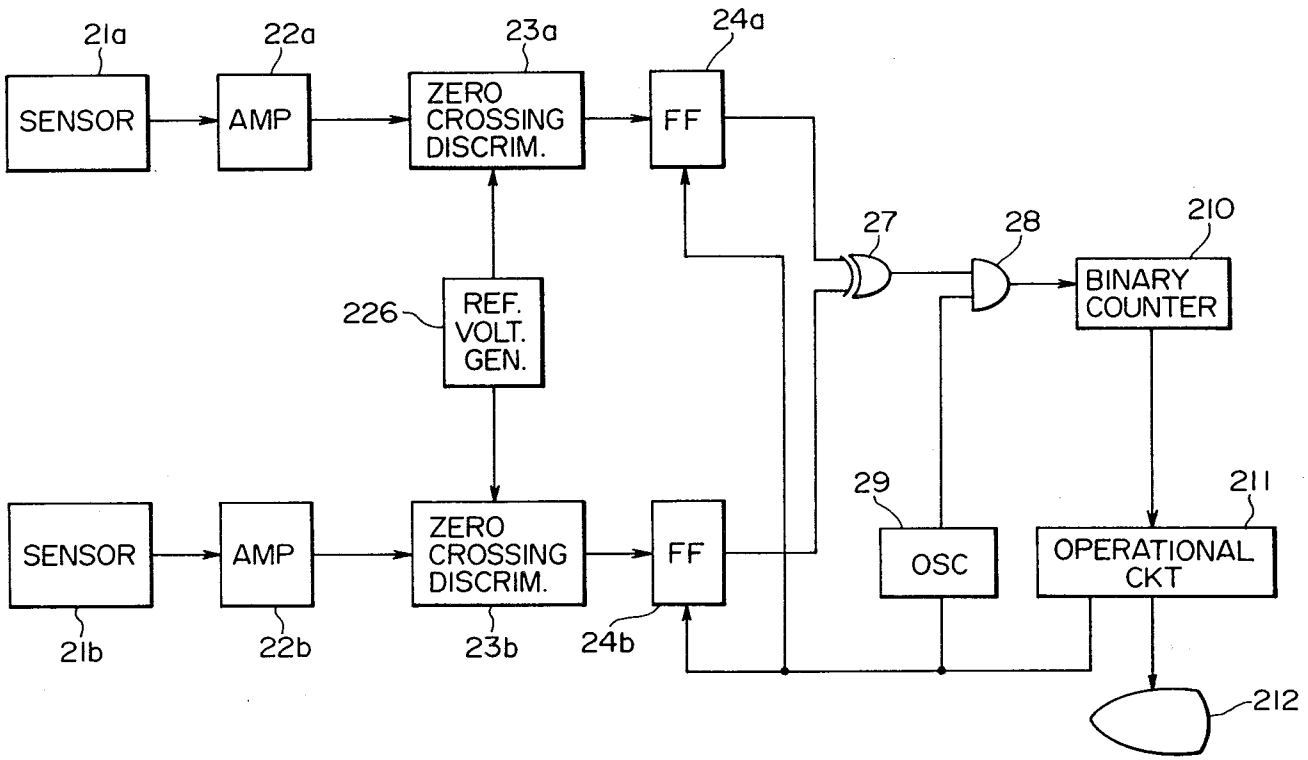
FIG. 14 is a block diagram of an electric circuit used in this embodiment.
Figure 16:
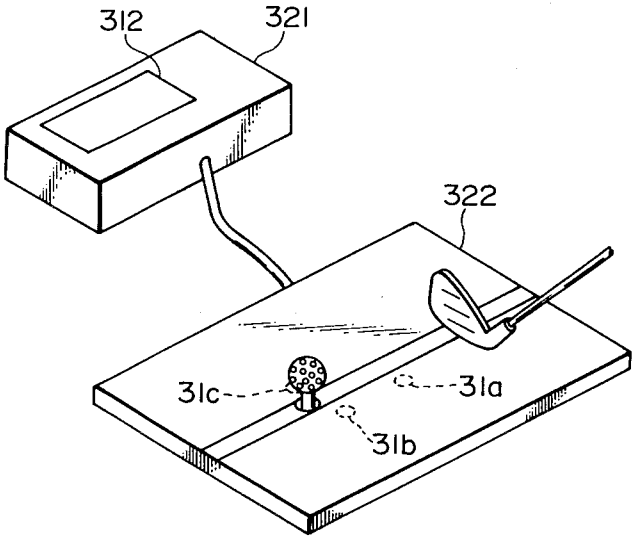
FIG. 16 is a perspective view of another embodiment of a golf trainer according to the present invention.
Figure 15:
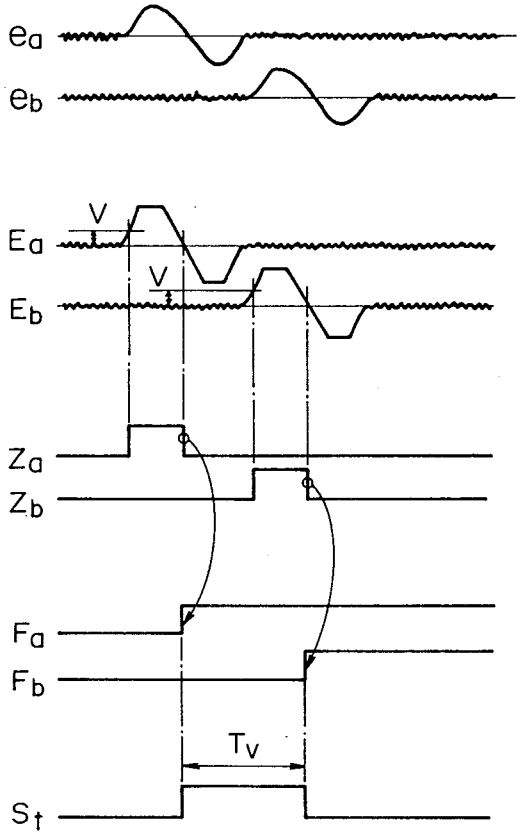
FIG. 15 is a timing chart of the output signals.
Figure 19:
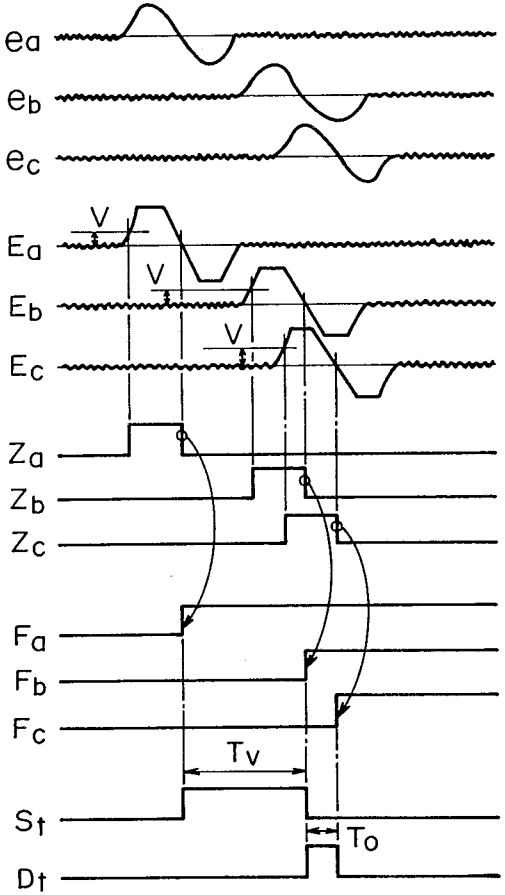
FIG. 19 is an output signal timing chart.
Figure 17:
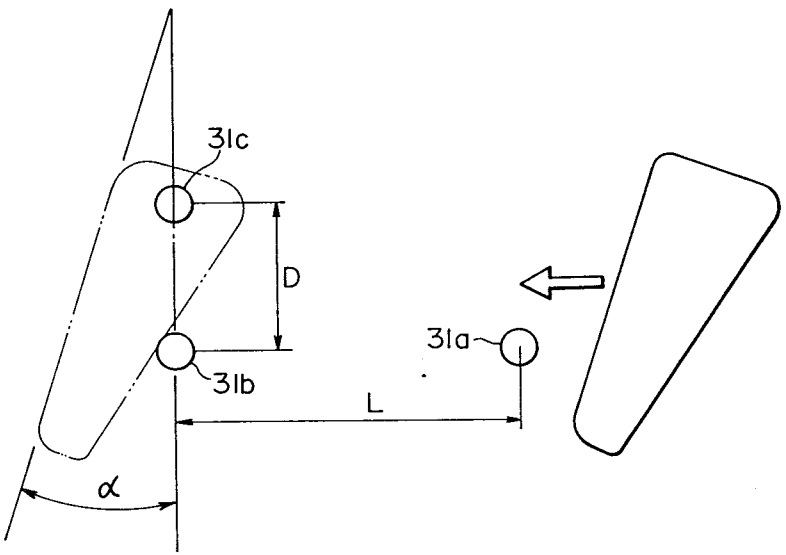
FIG. 17 is a diagram illustrating the interrelations between simplified magnetic sensors and a simplified club head thereof.
Figure 18:
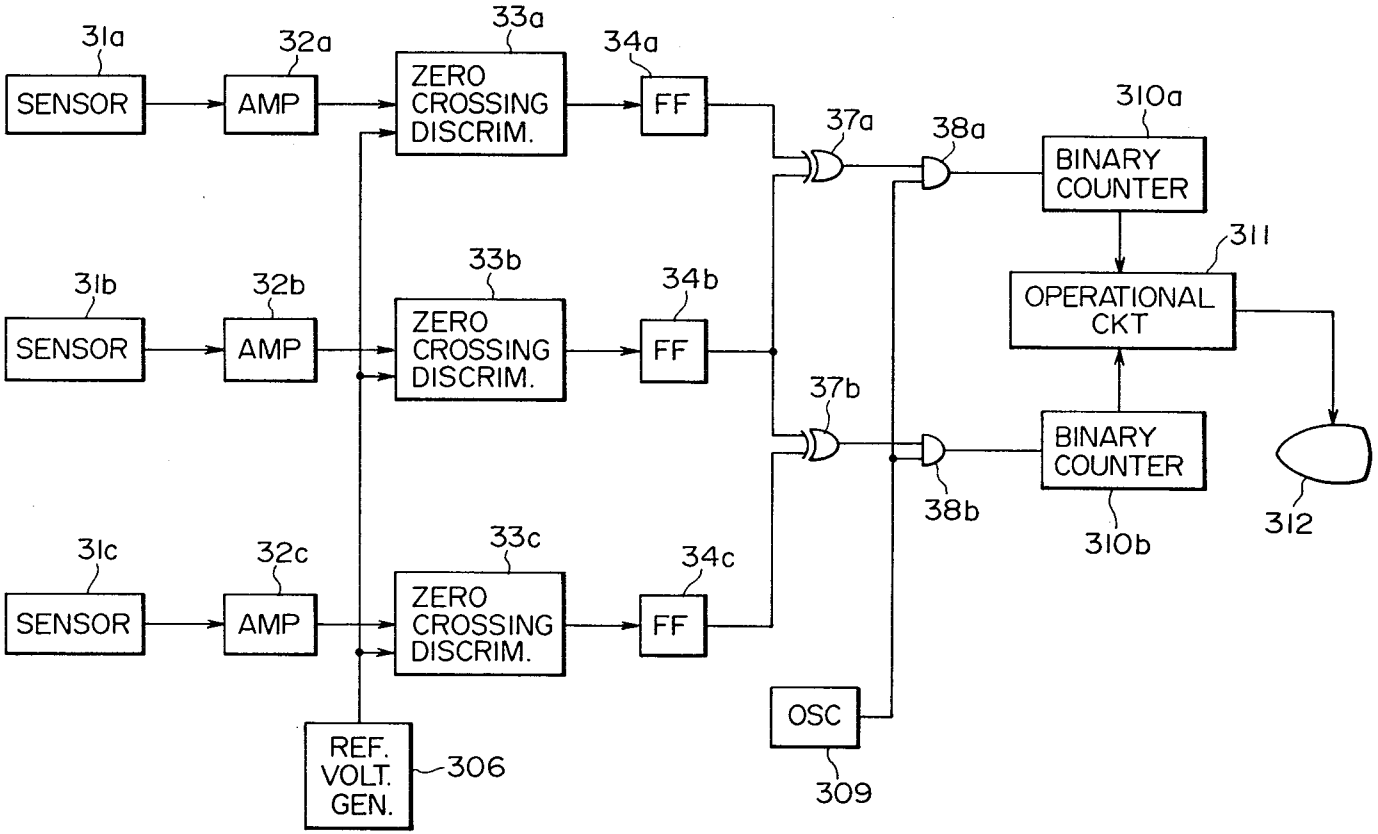
FIG. 18 is a block diagram of an electric circuit thereof.
Figure 20:
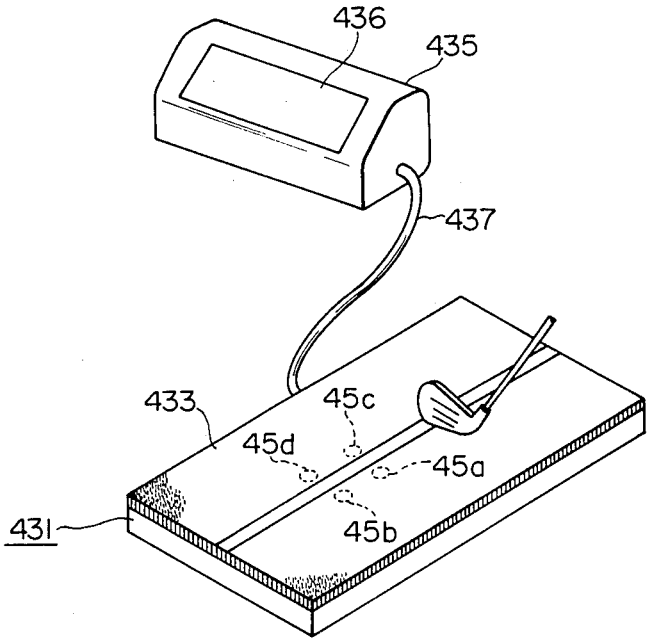
FIG. 20 is a perspective view of a fourth embodiment of a golf trainer according to the present invention.
Figure 21:
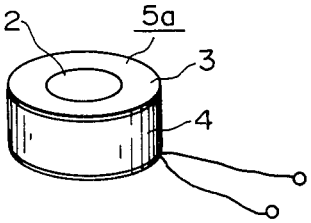
FIG. 21 is a perspective view of the magnetic sensor thereof.

With respect to carry of the ball of item (2) above, head velocities and the resultant carry of a ball are statistically processed for each kind of club to obtain curves 104, etc. as shown in FIG. 11. Then, each curve is resolved into a combination of a linear formula and a quadratic formula. Finally, the carry C of the ball is approximately calculated using this composite formula.

With respect to the face angle of item (3), this parameter is approximately calculated by the following equation:

$$\alpha=\mathrm{Tan}^{-1}\,[(L\times T_O)/(D\times T_s)]$$

With respect to the direction $\theta$ in which the ball is directed (item (4)), this is calculated by vector transformation in a manner in which a closer approximation is made than with the face angle $\alpha$ and head velocity V. Further, the calculated angle $\theta$ can be divided into sections such as 0°–4°, 5°–9°, 10°–19° and 20° or more for display purposes to roughly indicate the direction.

With respect to the orbit of the club head (item (5)) a straight orbit is approximately calculated by the following relations:

$$E_a/3 \leqq |E_a-E_b|,$$

$$E_b/3 \leqq |E_a-E_b|,$$

$$K\ (\text{constant})<E_a \text{ and } K<E_b.$$

Then, outside orbits and inside orbits can be calculated based on the aforesaid data taking detected data into consideration.

With respect to the hitting or impact position, toe, sweet and heel positions are approximately calculated in the same manner as in (5) above by the following relations:

$$E_c/3 \leqq |E_c-E_d|,$$

$$E_d/3 \leqq |E_c-E_d|,$$

$$K<E_c \text{ and } K<E_d.$$

With respect to the distance S from a target as described above, approximately values can be calculated using the following equation:

$$S = C \times \sin \alpha$$

With respect to the judgment as to whether the swing was successful, if the velocity V of club head is higher than a predetermined constant K, for example 60 m/sec, then the swing will approximately be judged to be unsuccessful. On the other hand, if the velocity is slower than K, it will be judged to be normal.

Finally, with respect to the judgment of item (9) above, if the distance S from the target is larger than a predetermined constant I, for example 40 m, then the swing will approximately be judged to be abnormal. On the other hand, if the distance S is shorter than the constant I, the swing will be judged to be normal.

Referring to the flow chart shown in FIG. 8, the operations for calculating the various parameters are described. First, the calculation memory is initialized (S1), and then it is checked whether a start signal ST from the sensor 6*b* is detected (S2). If this signal is not detected, it is checked whether the club selecting key 8 has been depressed to select a desired club or the carry/head speed switchover key 7 has been depressed to select a desired display (S3). If either key is actuated, then club data is selectively fetched from the club data memory 23, and data on the carry/head speed switchover is applied to the display portion 33, and at the same time the selected club data is applied to the carry calculator (not shown) and stored (S4). If no key is depressed in process step S3, then the flow returns to process step S2 with the club data having been initialized in S1 and the carry/head speed changeover data remain unchanged. If the start signal ST is detected in the process step S2, then it is checked whether signals from the sensors 6*c* and 6*d* are detected (S5). If not (NO), the flow returns to process step S2. If so (YES), the flow proceeds to process steps S6 and S7 so as to permit the microcomputers 31 and 42 to process the respective information. The microcomputer 42 receives detected signal level and time data $T_a$, $T_b$, $T_c$ and $T_d$ to calculate the swing orbit and the hitting position (S6, S8), and then judges whether the microcomputer 31 has requested a transfer of the results of these calculations (S9). If there exists such a request, then the calculated data is transferred (S10), and thereafter the calculation memory is cleared (S11), and then the flow returns to step S2.

The microcomputer 31 receives time data $T_S$ and $T_o$ from the sensors to calculate various information (S7, S12), and then transfers a data request instruction to receive information in process step S8 (S13). It then judges whether data from S10 is received (S14), and then this various information is caused to enter the display portion and the memory (S15). The flow then returns to S2, thus completing the flow chart.

Figure 6:
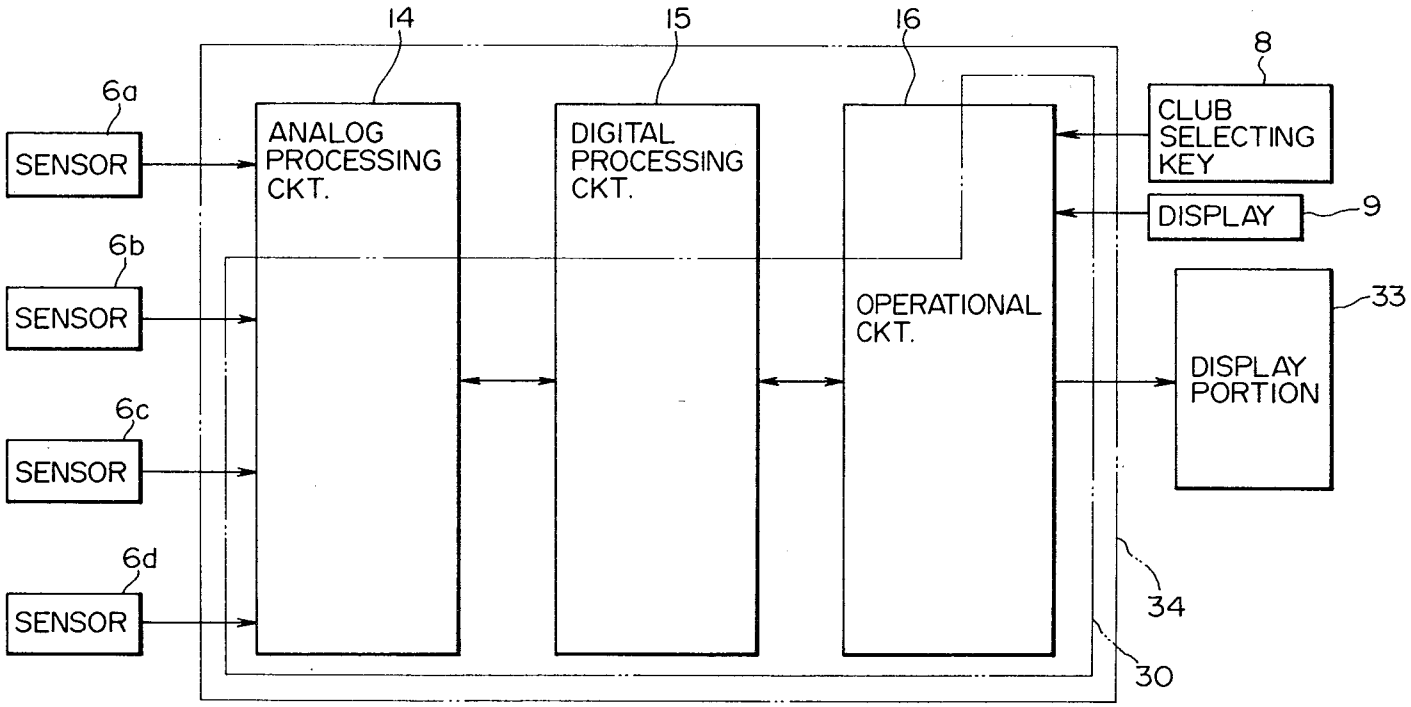
FIG. 6 is a functional block diagram of the electric circuit used in FIG. 1.

The aforementioned electric circuitry can be classified into four principal parts: an analog processing circuit 14, a digital processing circuit 15, an operational circuit 16 and a display portion 33, as shown in FIG. 6. A complementary MOS IC consuming a relatively small quantity of electric power is used in the digital processing circuit 15, and liquid crystal devices, which also consume a relatively small quantity of electric power are used in the display portion 33. Further, the operational circuit 16 uses a microcomputer consuming little electricity and, therefore, the whole apparatus consumes very little power. As a result, the apparatus can be used outdoors for a long period of time while supplied with electric power from a battery (not shown). Furthermore, the analog processing circuit 14 uses an IC which consumes little electricity, or the whole circuit 14 is so formed that it consumes less electricity to enhance the aforementioned energy savings.

In the operation of the structure described hereinbefore, the club selecting key 8 (which is not necessarily required) is depressed by a user to select the golf club used. If she swings thereafter, various information relative to the swing will then be calculated and displayed.

Another embodiment of the invention will now be described, referring to drawing FIGS. 12–15. A display device 221 holds a display portion 212 (described later), a processing circuit and so on therein. A white line 223 is drawn on a base mat 221 along the swinging orbit, and a tee 224 is placed on the mat, in which magnetic sensors 21*a* and 21*b* are buried in position. The magnetic sensors 21*a* and 21*b* are disposed at an interval L (for example, 10 cm) in the swing orbit of the club head 213. Amplifier circuits 22*a* and 22*b* amplify detected signals $e_a$ and $e_b$ from the respective magnetic sensors 21*a* and 21*b* by a predetermined factor and eliminate radio-frequency induced noise to produce amplified output signals $E_a$ and $E_b$, respectively. Zero-crossing discrimination circuits 23*a* and 23*b* separate the zero-crossing points of the detected, amplified signals at which the magnetic flux in said magnetic sensors shows the greatest change, and the detected signals are converted to pulse signals $Z_a$ and $Z_b$ which rise at a noise level cut voltage V produced from a reference voltage generator circuit 226 and fall at the respective zero-crossing points.

Flip-flop circuits 23*a* and 24*b* receive points from respective zero-crossing discrimination circuits 23*a* ans 23*b* and produce signals $F_a$ and $F_b$ which are set at the fall points, respectively. An exclusive-OR circuit 27 receives outputs from the flip-flop circuits 24*a* and 24*b* and produces a signal $S_t$ having a pulse width equal to the time $T_v$ it takes for the club head to pass through the interval between the magnetic sensors 21*a* and 21*b*. An AND circuit 28 ANDs the signal $S_t$ and a given high frequency clock pulse (for example, 400 KHz) from an oscillation circuit 29, and the resultant output is applied to a high speed binary counter 210 for counting the number of pulses. An operational circuit 211 consisting of a microprocessor (for example, an MPD-7502G) calculates the speed of the club head from the interval L between the magnetic sensors and the time $T_v$ resulting from the output from the counter 210 based on a calculation formula, $$V = L/T_v$$

and produces the result as an output. A display portion 212 receives the output from the operational circuit 211 and displays the speed per second in meters.

Thus, when a golfer swings while standing before the trainer, the device reads out the speed of the swinging club head precisely and displays it on the display portion.

A third embodiment of the invention will now be described with reference to FIGS. 16–19. Referring to the drawings, a display device 321 similar to that of the previous embodiment holds a display portion 312 and processing electronics. A base mat 322 contains magnetic sensors 31*a*, 31*b* and 31*c* buried in position. The magnetic sensors 31*a* and 31*b* are disposed at an interval L (for example, 10 cm) in the swing orbit of the club head, and the sensor 31*c* is disposed at right angles to the magnetic sensor 31*b* at a distance D (for example 4 cm) from the sensor 31*b*. Amplifier circuits 32*a*, 32*b* and 32*c* amplify detected signals $e_a$, $e_b$ and $e_c$ from their respective magnetic sensors 31*a*, 31*b*, 31*c* by a predetermined factor and eliminates noise to produce amplified output signals $E_a$, $E_b$ and $E_c$, respectively. Zero-crossing discrimination circuits 33*a*, 33*b* and 33*c* separate the zero-crossing points of the detected, amplified signals at which magnetic flux in said magnetic sensors shows the greatest change, and the detected signals are converted to pulse signals $Z_a$, $Z_b$ and $Z_c$ which rise at a noise level cut voltage V produced from a reference voltage generator circuit 306 and fall at their respective zero-crossing points.

Flip-flop circuits 34*a*, 34*b* and 34*c* receive outputs from the respective zero-crossing discrimination circuits 33*a*, 33*b* and 33*c* and produce signals $F_a$, $F_b$ and $F_c$ which are set at the fall points, respectively. An exclusive-OR circuit 37*a* receives outputs from the flip-flop circuits 34*a* and 34*b* and produces a signal $S_t$ having a pulse width equal to the time $T_v$ it takes for the club head to pass through the interval between the magnetic sensors 31*a* and 31*b*. The arrangement described thus far is substantially similar to that of the second embodiment described above.

An exclusive-OR circuit 7*b* receives outputs from the flip-flop circuits 34*a* and 34*c* and produces a signal $D_t$ having pulse width equal to the time $T_o$ it takes for the club head to pass through the interval between the magnetic sensors 31*b* and 31*c*. An AND circuit 8*a* ANDs the signal $S_t$ and a given high frequency clock pulse (for example, 400 KHz) from an oscillation circuit 309, and the resultant output is applied to a high speed binary counter 310*a* for counting the number of pulses. Similarly, an AND circuit 38*b* ANDs the signal $D_t$ and the high frequency clock pulse from the oscillation circuit 309, and the resultant output is applied to a high speed binary counter 310*b* for counting the number of pulses. An operational circuit 311 consisting of a microprocessor (for example, an MPD-7502G) calculates the face angle of the club head from the distances D and L between the magnetic sensors 31*a*, 31*b* and 31*c* and from the periods of time resulting from the outputs and from the counters 10*a* and 10*b* based on a calculation formula:

$$\alpha = \mathrm{Tan}^{-1}(L/D)\cdot(T_o/T_v)$$

and produces the result as an output. The display portion 212 receives the output from the operational circuits and displays the result in degrees.

Thus, when a golfer swings while standing before the trainer of this embodiment, the device reads out the face angle of the swinging club head precisely and displays it on the display portion.

A fourth embodiment of the invention will now be described with reference to FIGS. 20–24. A base mat 431 has a lawn-like portions 433 and a line on the center line of the orbit of a club head in an ideal swing. Magnetic sensors 45*a*, 45*b*, 45*c* and 45*d* are buried in position along the ideal orbit of the club head. A display device 435 includes a circuit portion (described later) and a display portion 436, and output signals from the magnetic sensors are applied to the display device through a connecting line 437. Each of the magnetic sensors 45*a*, 45*b*, 45*c* and 45*d* consist of a coil 44 wound on a bobbin 43, a permanent magnet 42 fixedly inserted in a central bore in the bobbin 43, and a shielding membrane 41 shielding these elements.

Figure 22:
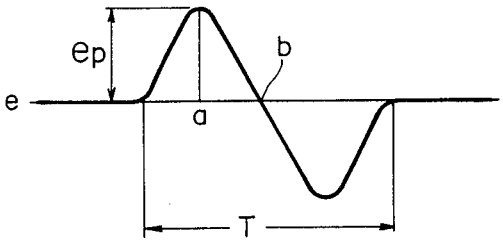
FIG. 22 is a waveform of a detected signal.
Figure 23:
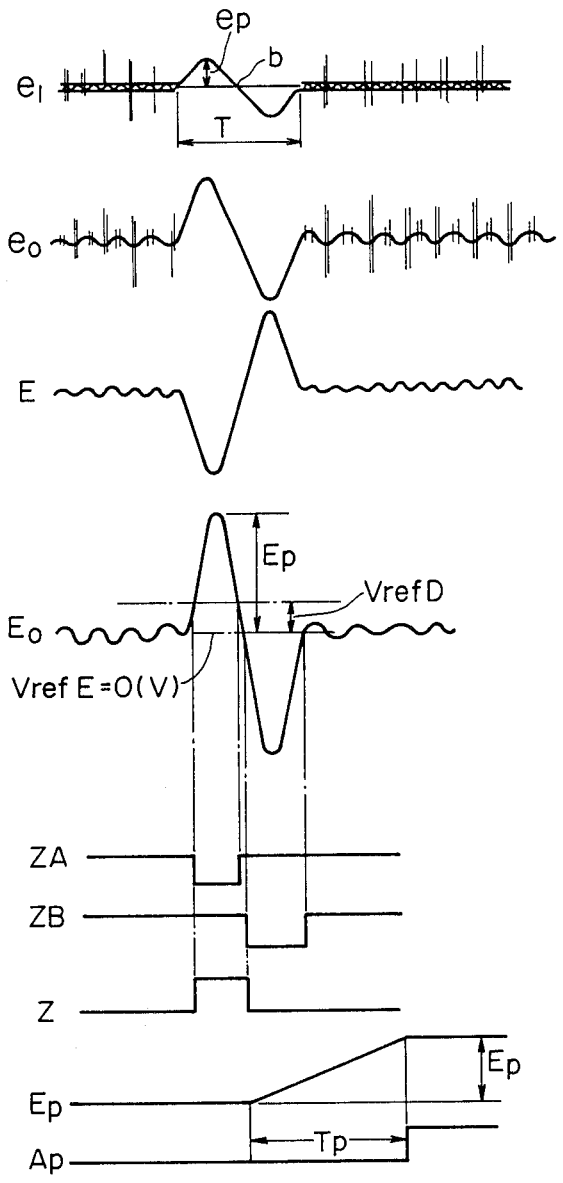
FIG. 23 is a view showing the waveform of a signal processed in the processing circuit.

Referring next to FIGS. 22 and 23, detection of the moving state of the club head in this embodiment will be described.

When the club head passes over the magnetic sensor 45*a* at a certain velocity, the quantity of magnetic flux issuing from the permanent magnet 42 and passing through the coil 44 changes and induced electromotive force e is generated in the coil 44. The waveform of the electromotive force e changes so that its peak value and frequency vary in proportion to the velocity of the passing club head, and the larger the interval between the magnetic sensor 45*a* and club head, the smaller the peak value will be.

Figure 24:
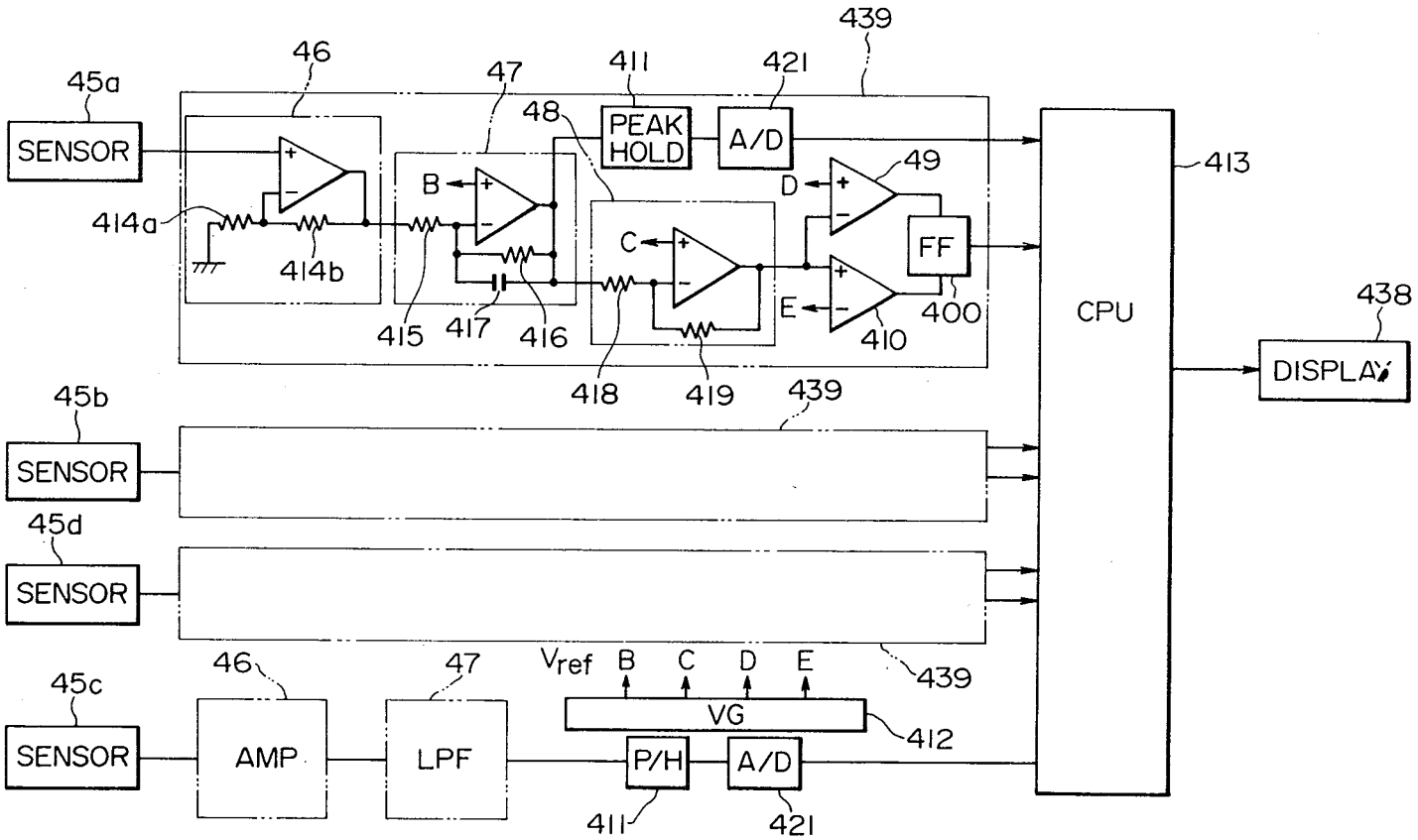
FIG. 24 is a block diagram showing the electric circuitry of a processing circuit.
Figure 25:
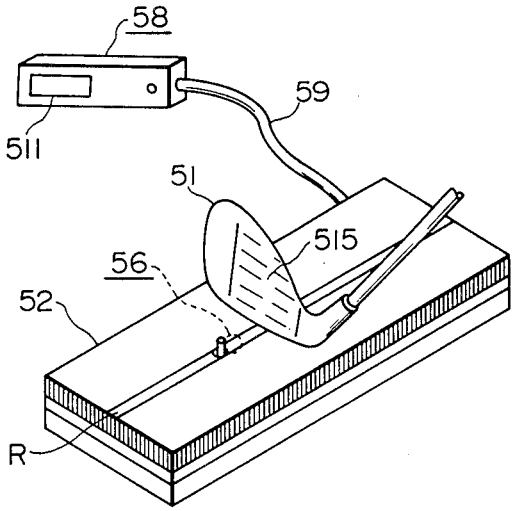
FIG. 25 is a perspective view of a further embodiment of a golf trainer according to the present invention.
Figure 26:
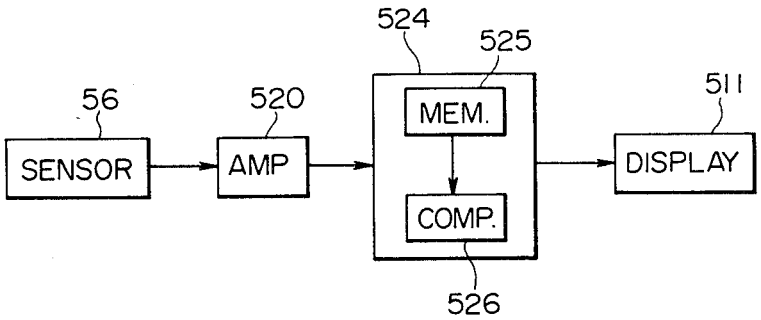
FIG. 26 is a block diagram of an electric circuit therefor.

Referring next to FIGS. 23 and 24, an example in which only a necessary signal is discriminated relative to the induced noise and the detection signal indicative of the swinging state will be described.

When the club head moves in a direction indicated by an arrow (FIG. 2(*a*)) upon swinging, the output from the sensor 45*a* can be represented by a signal $e_1$ which includes extraneously induced noise, as shown in FIG. 23. This induced noise is considerably reduced by the shield 41, but it remains to some extent, and is required to be removed. In FIG. 24, an amplifier circuit which amplifies the minute signal from the sensor 5*a* by a predetermined factor is indicated by numeral 46, and resistors 414*a* and 415*b* define the aforementioned factor. A low-pass filter (abbreviated LPF hereinafter) 46 removes high frequency noise components from the output signal $e_o$ which includes both noise and the detected signal indicative of the swinging state, and the filter acts as a means for amplifying the signal from which the noise has been removed by a predetermined factor, which factor is in turn defined by resistors 415 and 416. The range of high frequency components to be removed is determined by a combinatiion of the resistor 416 and a capacitor 417. An amplifier circuit 48 amplifies the signal $e_o$ by a predetermined factor, determined by resistors 418 and 419, so as to facilitate removal of low frequency noise components from the output signal E from the LPF circuit 47. A comparator circuit 49 which receives the output signal $E_o$ from the amplifier circuit 48 and a reference voltage D ($V_{ref}$) from a reference voltage generator (VG) circuit and compares their levels. Similarly, a comparator circuit 410 compares the levels of the output signal $E_o$ and $V_{ref}$. A flip-flop (FF) circuit 416 operates by receiving the output signal ZA from the comparator circuit 49 and the output signal ZB from the comparator circuit 410, which with 49, FF circuit 416 and VG circuit 412 operate as a low frequency component level lowering means. A peak holding circuit 411 holds the peak or the maximum voltage value $E_p$ of the output signal E from the LPF circuit 47, and the maximum voltage value $E_p$ from the peak holding circuit 11 is converted to digital form by an A/D converter circuit 421. A central processing unit (CPU) 13 calculates a signal $T_p$ from the output signal $A_p$ of the A/D converter circuit 421 and arithmetically derives various information based on the signal Z from the FF circuit 16 and other inputs as shown. The VG circuit 412 generates various reference voltages, such as $V_{ref}B$, $V_{ref}D$, etc. Also included in this processing circuit are a display portion 438, the aforementioned amplifier circuit 46 indicated by numeral 439, LPF circuit 47, amplifier circuit 48, comparator circuit 49, comparator circuit 410, peak holding circuit 411, A/D converter circuit 421 and FF circuit 416.

The amplification factor of the amplifier circuit 46, the cut-off frequency of the LPF circuit 47, the amplification factor of the amplifier circuit 48 and the reference voltage constants of the VG circuit 412 will now be described in more detail.

The conditions under which the club head passes over the sensor 45*a* can be considered as follows to determine the constants: (1) the height at which the club head always hits the golf ball, (2) the velocity of the club head which causes the golf ball to fly or roll, (3) the velocity of the club head reasonably attainable, and (4) orbits of the club head and hitting positions which permit no hitting of the ball.

First, with respect to (1), the interrelation between the club head and the sensor has a close relationship with the velocity of the club head referred to in (2) above. The circuit is designed so that the detected signal voltage from the sensor 45*a* when the club head narrowly hits a golf ball at its minimum velocity at the highest elevation, and the detected signal voltage from the sensor 45*a* when the club head hits a ball and almost rubs the mat at its maximum velocity at the lowest elevation are both greater than the induced noise. Further, the amplification factor of the amplifier circuit 46 is so determined that no saturation will occur when the detected signal voltages are amplified in the circuit.

With respect to (3), a head velocity, for example, 60 m/sec, is calculated in terms of time T of the detected signal e from the sensor 45*a*, and this time is converted to a frequency employing the following relation:

$$f=1/T$$

Then, a cut-off frequency $f_c$ for the higher components is calculated, and then LPF circuit 47 is designed so that it has a constant equivalent to this cut-off frequency.

Finally, with respect to (4), in order to calculate the orbit and hitting position, the maximum voltage value $E_p$ from the LPF circuit 47 should be precisely detected. For example, in relation to the relation (1) and (2), when the head velocity is less than a certain value, such as 10 m/sec, the signal cannot be sufficiently amplified and, therefore, the maximum voltage value $E_p$ from the LPF circuit is made ineffective. The amplifier circuit 48 acts to detect a zero-crossing point, and the amplification factor is set to a relatively high value in order to determine the zero-crossing point more clearly. As a result, almost all amplified signals will saturate.

Under these conditions, the VG circuit 412 is constructed so that it generates reference voltage, $V_{ref}B$ and $V_{ref}C$ so set that the circuit may stably operate in various circumstances, $V_{ref}D$ is set so that it is considerably greater than the amplified low frequency noise, and $V_{ref}E$ is set to a voltage value for deriving the zero-crossing crossing point b, for example, 0 volts of the detected signal from the sensor 45*a*.

In the description above, only the magnetic sensor 45*a* was described in detail, but the magnetic sensors 45*b* and 45*d* function in the same manner as the sensor 45*a*. The magnetic sensor 45*c* operates simply in association with the peak holding operation in the processing circuit 439. Also sensors consisting of a coil having a permanent magnet in the center thereof were referred to, but other magnetic sensors, such as search coil or Hall effect elements, may be used instead. Further the number of the elements is not limited to four. It is also noted that the aforementioned high frequency filtering means and low frequency level lowering means can be replaced by other means which attain the same purposes.

A further embodiment of the present invention will now be described with reference to FIGS. 25–32.

Referring to the drawings, there are shown the head 51 and face 515 of a golf club. The gold trainer has a base 52 constructed similarly to that of previous embodiments. Magnetic sensor 56, buried along the center line R of the swing orbit, consists of a permanent magnet 562 and 563 buried in a resin 564 of, for example, epoxy, within a case 561 of resin. A display device 58 includes an amplifier circuit 520 for amplifying the detection signal from the magnetic sensor 56 resulting from the change in magnetic flux. Also included in the display device 58, which is connected to the magnetic sensor 56 through a signal line 59, are a processing circuit 524 for processing the output from the amplifier circuit and a display portion 511 consisting of liquid crystal display devices for displaying the processing result.

Figure 27:
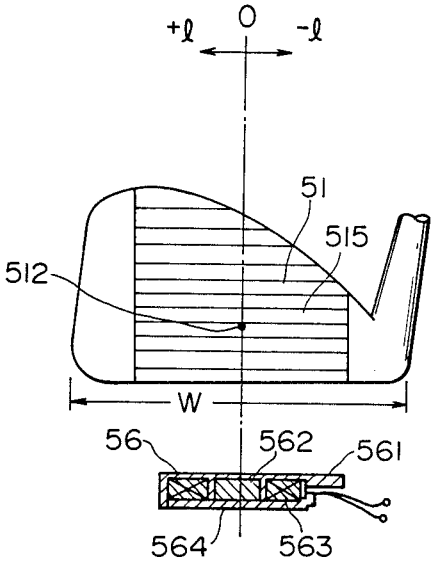
FIG. 27 is a view illustrative of a club head passing over a magnetic sensor, and of a magnetic sensor.
Figure 28:
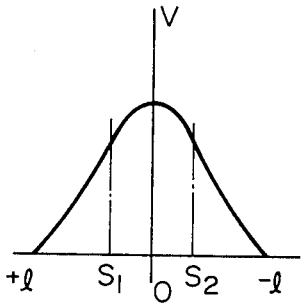
FIG. 28 is a voltage value curve of an output signal from the magnetic sensor of FIG. 27.

In the operation of this golf trainer, when the club head 51 passes over the magnetic sensor 56, the voltage value of the output signal from the magnetic sensor 56 exhibits a maximum in the event that the center 512 of the club head 51, which lies approximately in the center of gravity and concurrently approximately in the center of the sweet spot area, passes just above the magnetic sensor 56. The value decreases as the displacement toward the inside (−l) or outside (+l) increases, as shown in FIGS. 27 and 28. Further, an ordinary golfer may swing so that the club head 1 passes above the base 2 at approximately a constant elevation, and, therefore, by presetting the maximum outputs when the head passes just above the magnetic sensor 56 according to the kind of club head used, assuming the area of displacement between $S_1$ and $S_2$ to be the sweet spot area to be stored in a memory 525 of the processing circuits 524, and by comparing an amplified signal from the magnetic sensor 56 upon swinging with a corresponding preset value in a comparison portion 526 of the processing circuit 524, it can easily be displayed whether the ball was hit by the sweet spot area of the club or not.

Figure 29:
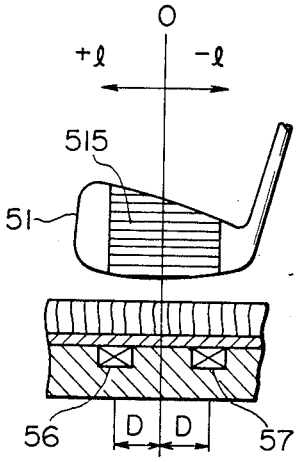
FIG. 29 is a view illustrative of a club head passing over magnetic sensors in another similar embodiment of the present invention.

A modification of the foregoing is shown in FIG. 29, where two magnetic sensors 56 and 57 are disposed on opposite sides of the center line R of the swing orbit within the orbit at a distance D (actual club heads have a width W of some 8 cm on the average, but herein the distance D is assumed to be 2 cm, shorter than the above value) from the center line, thus permitting the user to know whether his swing orbit is displaced toward the inside (−l) or outside (+l).

In FIGS. 29–32, reference numerals 51, 56, 57 and 515 are used in the same manner as in the above embodiment, and numerals 513 and 514 indicate voltage value curves $V_1$ and $V_2$ of the output signals from the magnetic sensors 56 and 57, respectively.

Figure 31:
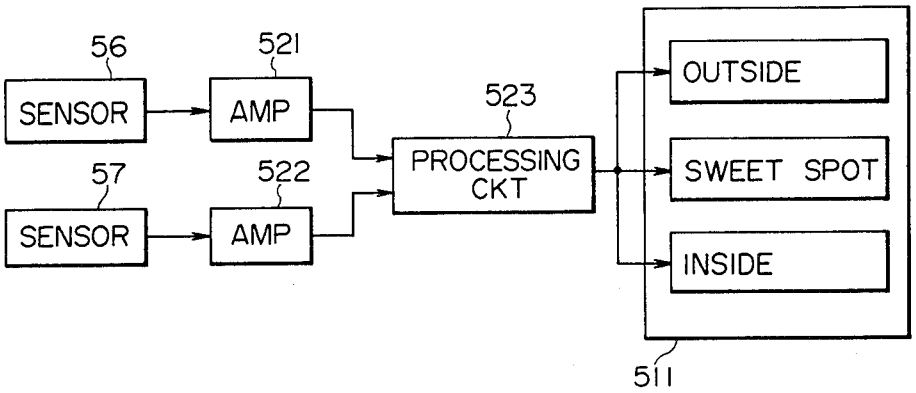
FIG. 31 is a block diagram of an electric circuit thereof.
Figure 32:
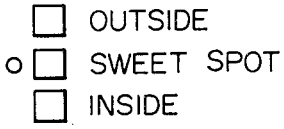
FIG. 32 is a view illustrating an example of a display.
Figure 33:
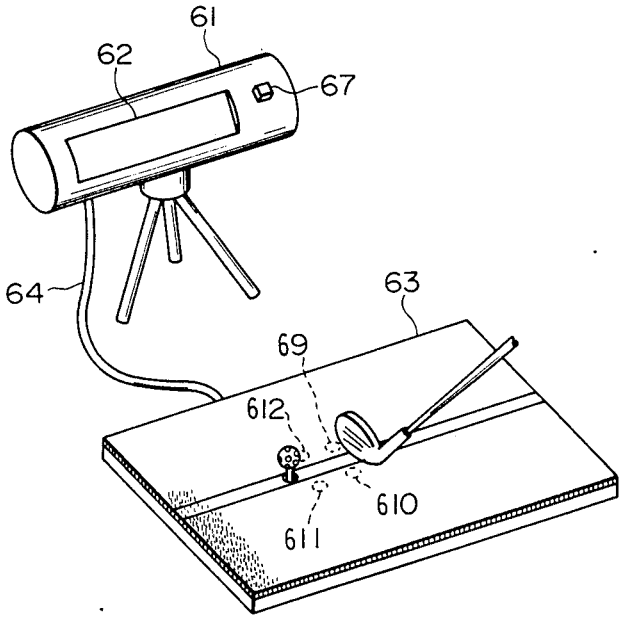
FIG. 33 is a perspective view showing another golf trainer of the present invention.

Detected outputs resulting from the structure described above are processed by an electric circuit shown in FIG. 31. Specifically, as the club head 51 passes over the magnetic sensors 56 and 57, these sensors produce signal voltage values $V_1$ and $V_2$ which are applied to amplifier circuits 521 and 522, which in turn amplify the values by a predetermined factor to produce outputs $V_1$ and $V_2$. A processor circuit 523 for receiving these outputs compares the magnitudes of the outputs to graphically display "outside", "sweet spot" or "inside" or the like on the display portion 511.

It is said generally that the sweet spot has an area having a diameter of some 20 mm, but the area is affected by differing club heads and golf balls. Accordingly, it is necessary to assume an area in the range of 10 mm to 30 mm in diameter.

Figure 30:
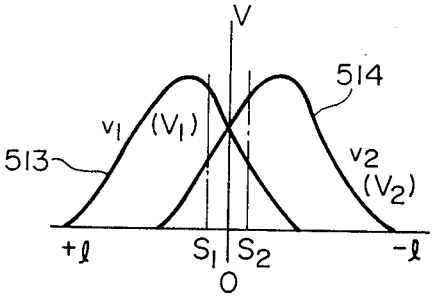
FIG. 30 is a voltage value curve of output signals from the magnetic sensors of FIG. 29.

As an example, if the sweet spot ranges from $S_1$ to $S_2$ on the abscissa in FIG. 30, then the output voltage value from the magnetic sensors at the $S_1$ point is as follows:

$$V_1=2V_2$$

Similarly, the value at the $S_2$ point is as follows:

$$V_2=2V_1$$

Therefore, the following relation holds between the $S_1$ point and the O point:

$$2V_2 \geqq V_1 \geqq V_2$$

and $$2V_1 \geqq V_2 \geqq V_1$$

holds between the $S_2$ point and the O point. Thus, it is possible to identify the aforementioned sweet spot. Also in this example, if $$V_1>2V_2 \text{ and } V_2>2V_1$$

occur, these are represented as "outside" and "inside", respectively. An example of the display is shown in FIG. 8.

It is noted that in this embodiment, an impact position of a ball (which is not required in actual fact) with the face of the club head is displayed by comparing the magnitude of voltage values produced from two magnetic sensors. However, the present invention is not limited to a comparison of the magnitudes of voltage values, and a comparison of the magnitudes of current values, a comparison of phase shifts etc., may be employed.

Figure 34:
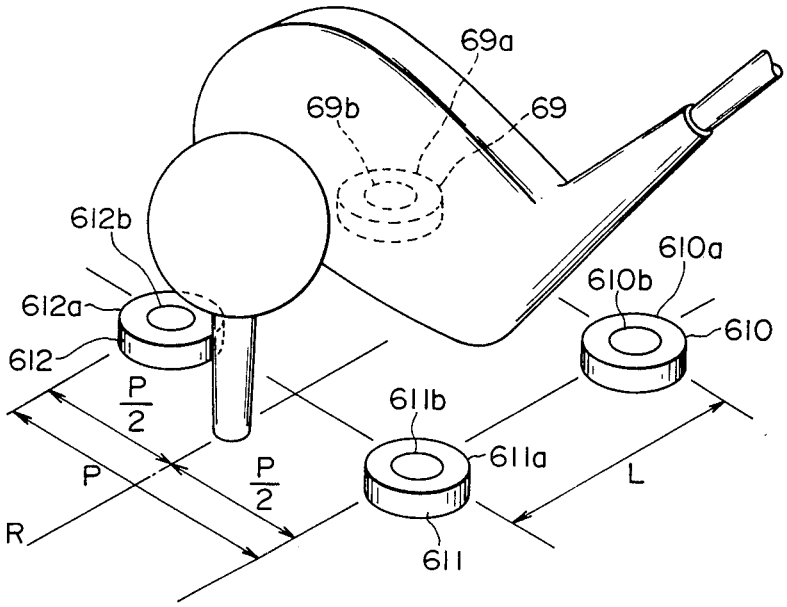
FIG. 34 is an enlarged view of the principal portion of FIG. 33.
Figure 36:
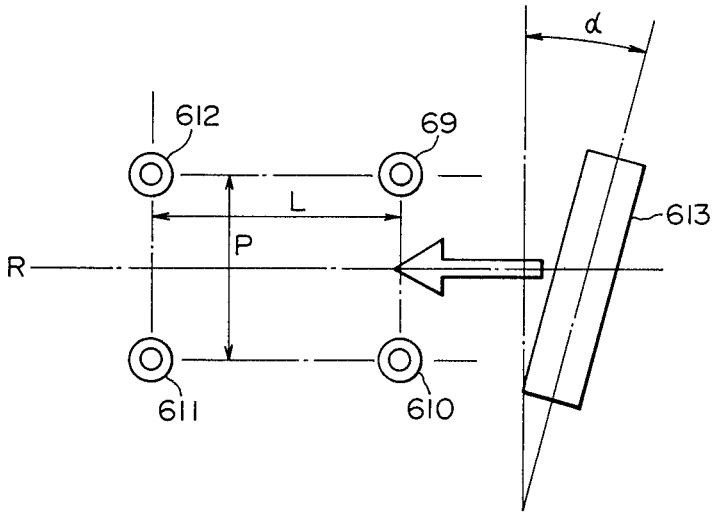
FIG. 36 is a plan view showing a sensor and a club head, both simplified, in use.

A final embodiment of the present invention will hereinafter be described. Referring to FIGS. 33–40, there is shown the body of a gold trainer similar to that of previous examples and having a control circuit 614 therein. Also shown as a display portion 62, a club selecting key 67, a base 63, such as a mat, connected with the body 61 through a cord 64, and a golf club head. Sensors 69, 610, 611 and 612 consist of magnets 69*b*, 610*b*, 611*b* and 612*b* and coils 69*a*, 610*a*, 611*a*, and 612*b* wound with a predetermined number of turns on these magnets, respectively, as is shown in FIG. 34. The sensors 611 and 612, forming a pair, are disposed on an ideal swing line R and on opposite sides of the line R spaced by the same distance P/2. The sensors 69, 610, also forming a pair, are disposed at a given distance L (for example 50 mm) from the pair of sensors 612 and 611, respectively, further away from the tee.

Figure 35A:
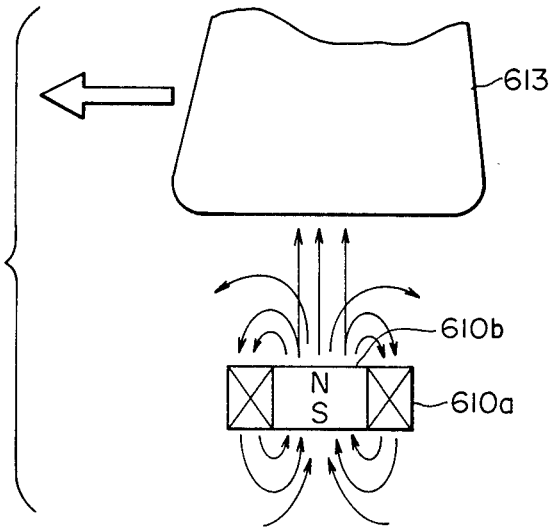
FIGS. 35(*a*) and 35(*b*) are views illustrative of the principles of detection of the sensors, wherein FIG. 35(*a*) is a longitudinal section of a club head and a sensor and FIG. 35(*b*) is a view illustrative of a zero-crossing voltage waveform generated.
Figure 35B:
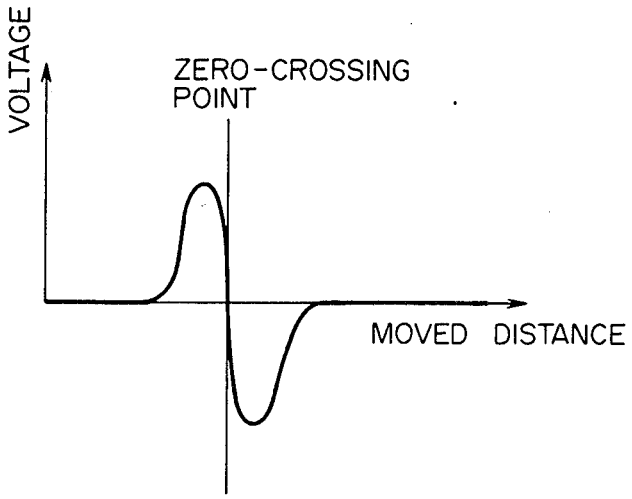

When the club head passes over the sensor 610, for example, at a certain velocity (for example, the hitting velocity) as shown in FIG. 35(*a*), an output having a voltage waveform as shown in FIG. 35(*b*) is produced by the sensor 610. Just when the center of the sensor 610 overlaps the center of the club head, the voltage drops to zero. The zero-crossing waveform crest value is proportional to the passing velocity.

Figure 37:
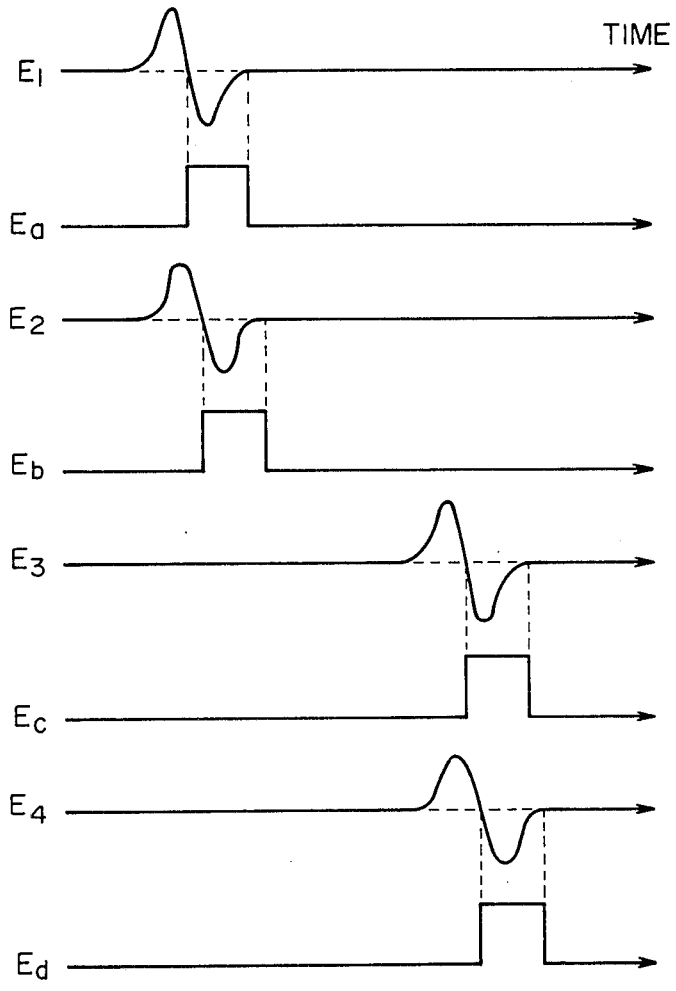
FIG. 37 is a timing chart of zero-crossing waveforms from the sensors, and detected signals.
Figure 38:
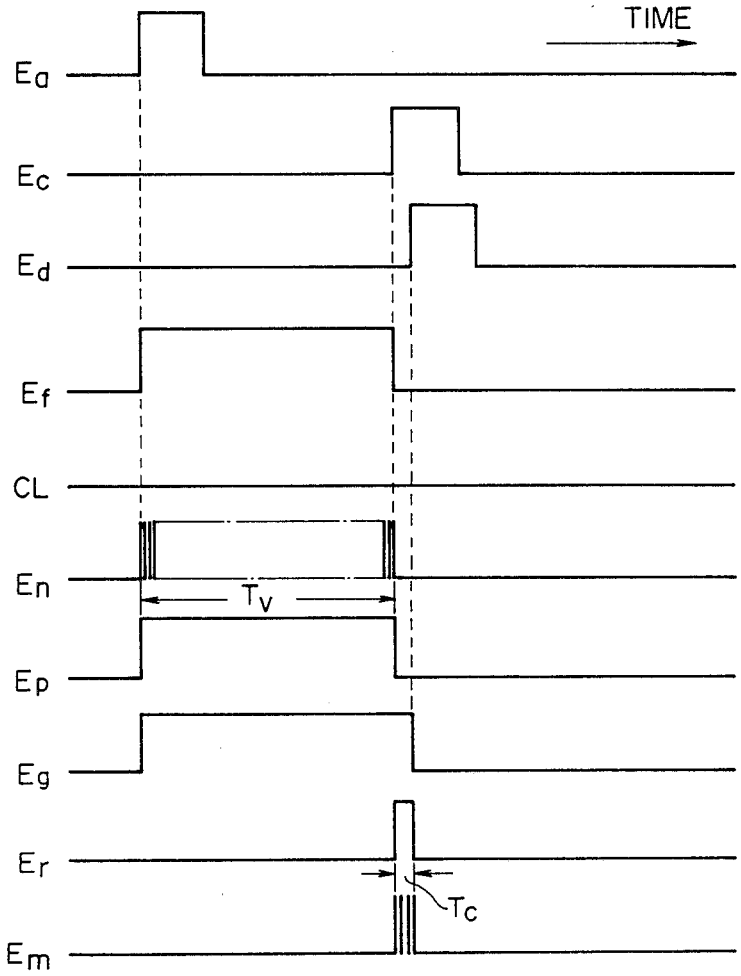
FIG. 38 is a view illustrating the data processing of the detected signals.
Figure 39A:
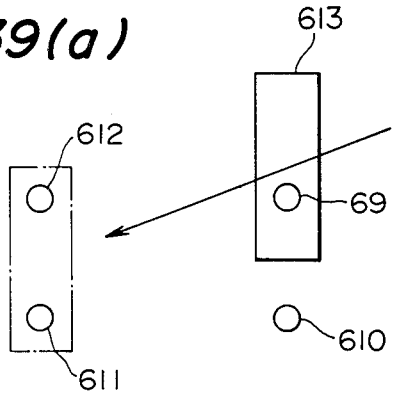
FIG. 39 is a view illustrative of exemplary blows, wherein parts (a), (b) and (c) show outside-in, straight and inside-out swing paths, respectively.
Figure 39B:
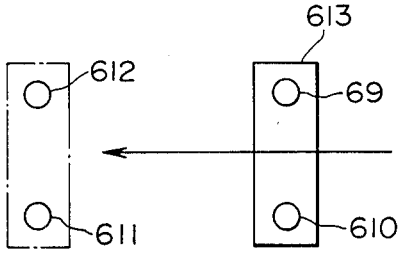
Figure 39C:
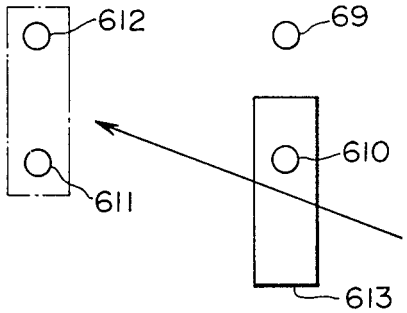

By utilizing the above principle, various conditions necessary for the judgment of the appropriateness of club swings can be detected as follows:

In the detection of six conditions: (1) swing velocity, (2) orientation of the club face, (3) carry of the ball, (4) impact point with the club face, (5) hit, and (6) distance from a desired target, if the club head passes just over the sensor 610 or near this sensor, then a voltage having a zero-crossing waveform $E_1$ as shown in FIG. 37 will be induced in the sensor 610. If the club head passes just over the sensor 69 or near this sensor, then a voltage having a zero-crossing waveform as shown at $E_2$ will be induced in the sensor 69. If the club head 13 passes just over the sensor 611 or near this sensor, a voltage having a waveform as shown at $E_3$ will be induced in the sensor 611, and finally, if the club head passes just over the sensor 612 or near this sensor, a voltage having a form as shown at $E_4$ will be induced in the sensor 612.

Accordingly, if the zero-crossing waveforms from the sensors 69, 610, 611 and 612 are detected from the respective zero-crossing moments to the respective terminations of the waveforms, detection outputs as shown at $E_a$, $E_b$, $E_c$ and $E_d$ are obtained, and these outputs can be used to judge the appropriateness of the swings.

With respect to the swing velocity of item (1) above, when a detected output $E_a$ occurs, a pulse is produced and applied to the set input of a flip-flop, and when a detected output $E_c$ develops, a pulse is produced and applied to the reset input of the flip-flop, resulting in a pulse output for measuring the velocity as shown at $E_f$. This pulse output $E_f$ is then ANDed with a clock pulse from a high frequency oscillator 621 to produce a clock signal as shown at $E_n$. The clock frequency of the signal $E_n$ is counted by a binary counter to derive the time difference $T_v$ between detected outputs $E_a$ and $E_c$. Then, the time difference $T_v$ is divided by the distance L between the sensors 610 and 611 to derive the swing velocity.

With respect to the orientation of the club face (item (2) above), a pulse is produced when the detected output $E_a$ is generated from the sensor 610, and this pulse is applied to the set inputs of two flip-flops. One of the flip-flops produces a pulse when the sensor 611 generates the detected output $E_c$, and this pulse is used as a reset input therefor to obtain an output as shown in FIG. 6 at $E_p$, while the other produces a pulse when the sensor 612 generates output $E_d$, and this pulse is used as its reset input to derive an output as shown at $E_g$. Then, a pulse output $E_r$, for measurement, which is proportional to the time difference between the two detected outputs $E_p$ and $E_g$ is obtained. Then, the pulse $E_r$ is ANDed with the clock pulse from the high frequency oscillator 621 in the same way as in the velocity detection to produce a clock output signal as shown at $E_m$. Thereafter, the clock frequency of this signal is counted by a binary counter to obtain the time difference $T_c$, and an inclination or orientation angle $\alpha$ can be obtained by the use of this time difference, the interval L between the sensors 610 and 611 and the interval P between the sensors 611 and 612.

With respect to the carry of the ball, or the distance traveled by the ball, of item (3) above, club head velocity data is preset for each kind of club and is stored in CPU 618, and specific data is selected by actuation of the club selecting key 67 to calculate the carry using this data and the aforementioned head velocity.

With the respect to impact point of the club face (item (4) above), the peak values of the zero-crossing voltage waveforms from the sensors 611 and 612 are compared, and if the lower peak is not smaller than the higher peak by a certain factor (for example, 75%), then the center of the club head 13 is judged to have passed generally above the ideal straight line R at the moment of impact. On the other hand, if the lower peak is smaller than the higher peak by the above factor, the club can be judged to have shifted toward the sensor producing the higher peak.

With respect to the detection of item (5) above, the blow can be judged by the specific one of the sensors 69, 610, 611 and 612 that detects the club head. Regarding an intermediate position between the sensors 69 and 610, the voltage values of zero-crossing waveforms of these sensors are compared in the same manner as the impact point with the club face of item (4) above was calculated. As a result, the center of the club head can be located between the sensors 69 and 610, and the direction of the swing can be judged by comparing this data and the aforementioned data from the sensors 611 and 612.

Finally, with respect to the distance from a desired target (item (6)), this can be calculated from the carry of the ball, the orientation $\alpha$ of the club face and the direction of the swing.

Figure 40:
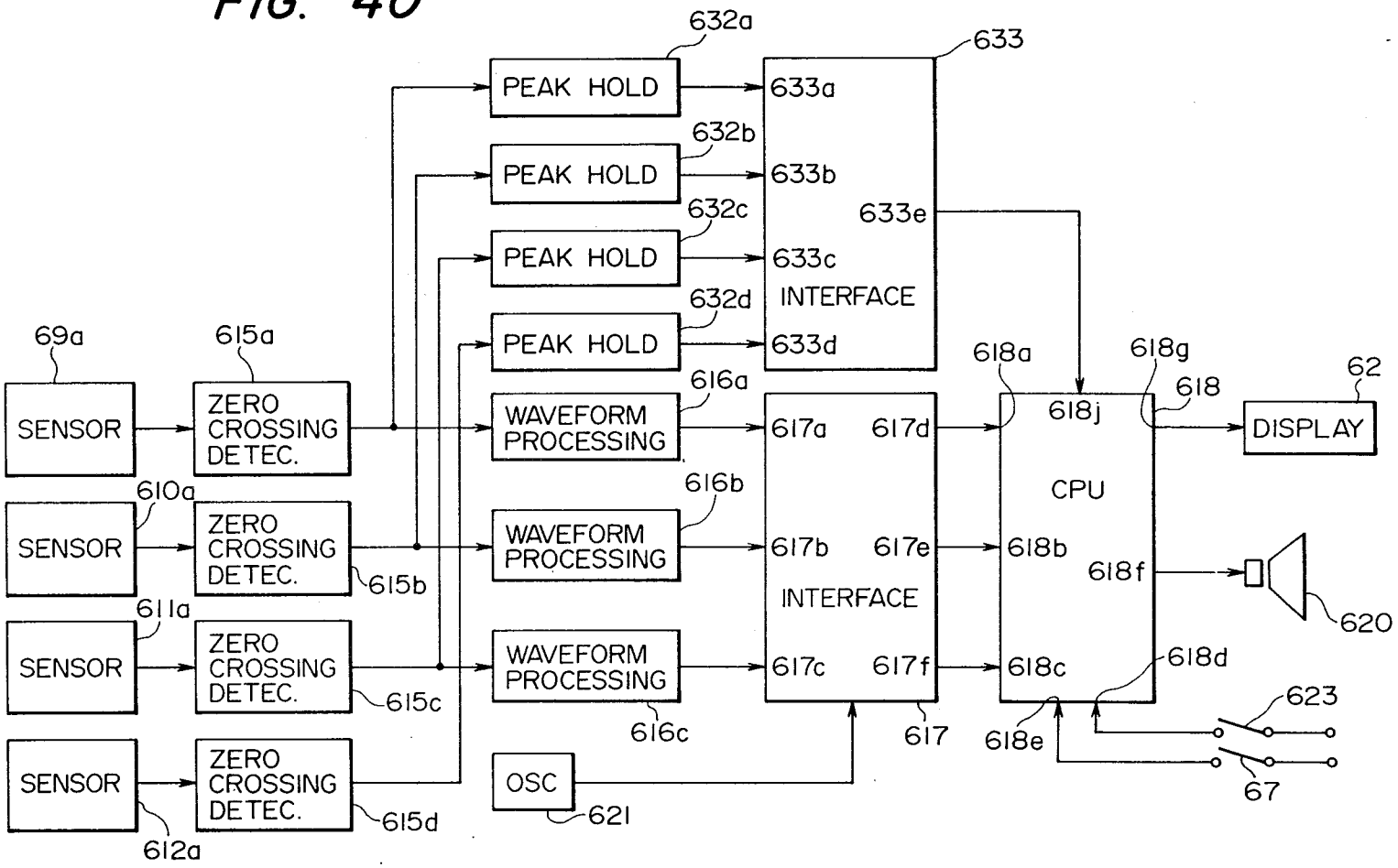
FIG. 40 is a block diagram of a control circuit.

The control circuit 614 of the present embodiment utilizing the detection principles described above will now be described in detail. Referring to FIG. 40, zero-crossing detection circuits 615*a*, 615*b*, 615*c* and 615*d* detect respective zero-crossing waveforms from the aforementioned sensors 69, 610, 611 and 612. Waveform processing circuits 616*a*, 616*b* and 616*c* convert the respective zero-crossing waveforms into predetermined detected waveforms which are produced as detected outputs $E_a$, $E_b$ and $E_c$ as shown in FIG. 37.

An interface circuit 617 converts the output signals from the waveform processing circuits into other signal forms which can be processed by the CPU 618. The interface circuit incorporates the aforementioned binary counters (not shown) for counting the number of clock pulses contained in the clock signals $E_n$ and $E_m$. Count outputs from the binary counters are held for a certain period of time, and are then applied to the CPU 18. The high frequency oscillation circuit 621 supplies high frequency pulses to the interface circuit 617.

Peak holding circuits 632*a*, 632*b*, 632*c* and 632*d* detect the peak values of the output voltages of the zero-crossing waveforms and hold them, and an interface circuit 633 reads out the peak values from the peak holding circuits and judges the aforementioned impact point and hit (items (4) and (5) above).

The CPU 618, which is a microcomputer, receives data from the aforementioned interface circuits 617 and 633 and processes the data for judging or calculating various swing parameters.

A display device 62 displays the result of the judgement or calculation of the CPU 618, and a loudspeaker 620 may read aloud such result. A reset switch 623 releases the state inhibiting data entry and resets the control circuit 614 to its initial condition. The club selecting key 67 is intended for selecting a specific data set from various club data determined from the reaction of a golf ball relative to various kinds of golf clubs.

In the operation of the structure thus described, the reset switch 623 is actuated, and then a swing is taken. The moving state of the golf club is detected by the sensors 69, 610, 611 and 612, and the zero-crossing detection circuits 615*a*, 615*b*, 615*c* and 615*d* receiving the detected signals produce zero-crossing waveforms, which in turn are processed by either the waveform processing circuits 616*a*, 616*b* and 616*d* or peak holding circuits 632*a*, 632*b*, 632*c* and 632*d*, and the signals are then applied to the loudspeaker 620 and/or display portions 62 through the interface circuits 627 and 633 and CPU 618 for displaying and/or reading aloud the signals as various information relative to the swing.

Thus, in accordance with the present invention, a very advantageous golf trainer can be provided which may include various processing means for performing processing based on detected signals from one or more sensors detecting the moving state of a club head, noise elimination means, and zero-crossing discrimination means for detecting points crossing a predetermined voltage based on the detected signals from the sensors, thereby permitting a precise, rapid and objective display of various information concerning a swing of a golf club.

What is claimed is:

1. A gold trainer comprising:

sensor means including a plurality of sensors each producing a voltage output signal indicative of swing condition when the head of a golf club passes thereover, said plurality of sensors being symmetrically disposed on opposite sides of an ideal swing line of said golf club and being spaced by the same distance with respect to said ideal swing line on said opposite sides thereof;

level processing means comprising peak holding circuits each holding a peak value of the voltage output signal produced by the corresponding sensor, a multiplexer circuit for subjecting outputs from said peak holding circuits to parallel-to-serial conversion, an analog-to-digital converter for subjecting outputs from said multiplexer circuit to analog-to-digital conversion, and a first control circuit for controlling said peak holding circuit, multiplexer and analog-to-digital converter;

zero-crossing discrimination means comprising a plurality of zero-crossing discrimination circuits each detecting a point crossing a zero level in the output signal from each of said sensors to produce a zero-crossing output signal, and detecting means for detecting the time difference between the zero-crossing outputs; and a second control circuit for controlling said zero-crossing discrimination circuits and said detecting means;

calculation means for calculating at least one of (1) the swing club head orbit and (2) an impact position of a ball relative to a club face, based on the output signal from said analog-to-digital converter, and for calculating at least one of (1) the swing velocity, (2) the carry of the ball, (3) the face angle of the club head, (4) the flying direction of the hit ball, (5) the distance from a desired target, (6) a hitting condition and (7) the judgment of whether the hit ball goes out of bounds or not, based on the output from said zero-crossing discrimination means, to produce an output signal; and display means for displaying the calculation result from said calculation means, wherein said sensor means includes four sensors, and wherein the calculation of the swing club head orbit is calculated based on each of the differences between the outputs of the respective paired sensors disposed on said opposite sides, the impact position is calculated based on the difference between the outputs of one of the two paired sensors which are located near the ball to be hit, wherein the club head velocity, the carry of the ball and the hitting condition are calculated based on the outputs of the other of the two paired sensors which are located toward the flying direction of the golf ball, and wherein the face angle, the flying direction, the distance from the desird target and the judgment of the ball position are calculated based on the outputs of said four sensors.

2. The golf trainer as defined in claim 1 wherein the club head velocity is obtained from L/Ts, where L represents an interval between said sensors disposed in the swing orbit direction and Ts represents the time required for the golf club to pass between said two sensors disposed at the distance L in the swing orbit direction, which is detected by said zero-crossing discrimination means.

3. The golf trainer as defined in claim 1 wherein the club head velocity is obtained from L/Ts where L represents an interval between said sensors disposed in the swing orbit direction and Ts represents the time required for the golf club to pass between said two sensors disposed at the distance L in the swing orbit direction, which is detected by said zero-crossing discrimination means, and wherein the carry of the ball is calculated from the club head velocity and the relation between the head velocities and the ball carry, which has been determined.

4. The golf trainer as defined in claim 1 wherein the swing orbit and the hitting position are calculated based on the difference between the voltage outputs of said sensors which are disposed on said opposite sides of said ideal swing line.

5. The golf trainer as defined in claim 1 further comprising filter means for eliminating signals unnecessary for obtaining data signals concerning the gold swing condition from the voltage output signals of said sensors.

* * * * *